US005799796A

United States Patent [19]

Azelton et al.

[11] Patent Number: 5,799,796

[45] Date of Patent: Sep. 1, 1998

[54] SPRING SYSTEM END CAP FOR PACKAGING FRAGILE ARTICLES WITHIN SHIPPING CARTONS

[75] Inventors: Kerry D. Azelton, Pleasanton; Richard L. Bontrager, Ripon; Benjamin F. Polando, Byron, all of Calif.

[73] Assignee: Innovated Packaging Company, Inc., Newark, Calif.

[21] Appl. No.: 759,386

[22] Filed: Dec. 4, 1996

Related U.S. Application Data

[63] Continuation-in-part of Ser. No. 52,650, Apr. 2, 1996, abandoned.

[51] Int. Cl.[6] ..... B65D 81/113

[52] U.S. Cl. ..... 206/586; 206/587; 206/591

[58] Field of Search ..... 206/453, 522, 206/523, 586, 587, 591, 592, 594; 420/35.7

[56] References Cited

U.S. PATENT DOCUMENTS

| | | | |
|---|---|---|---|
| 2,783,930 | 3/1957 | Riley | 229/14 |
| 2,808,189 | 10/1957 | Williams | 206/592 |
| 2,935,206 | 5/1960 | Smith | 211/65 |
| 2,974,788 | 3/1961 | Robbins | 206/65 |
| 2,994,466 | 8/1961 | Thompson | 229/30 |
| 3,146,932 | 9/1964 | Mayer | 206/594 |
| 3,176,743 | 4/1965 | Bundy | 150/42 |
| 3,181,766 | 5/1965 | Kane et al. | 229/14 |
| 3,192,978 | 7/1965 | Horvath | 206/592 |
| 3,366,231 | 1/1968 | Trakas | 206/65 |
| 3,437,423 | 4/1969 | Mondiadis | 21/83 |
| 3,724,654 | 4/1973 | Gerard et al. | 206/72 |
| 3,768,639 | 10/1973 | Dogliotti | 206/45.19 |
| 3,835,986 | 9/1974 | Le Beau | 206/320 |
| 4,006,818 | 2/1977 | Wannyn | 206/564 |
| 4,132,311 | 1/1979 | Glinert | 206/387 |
| 4,360,145 | 11/1982 | Wilcox | 206/594 |
| 4,398,212 | 8/1983 | Serry et al. | 358/93 |
| 4,645,079 | 2/1987 | Hill | 206/563 |
| 4,671,407 | 6/1987 | Brutosky | 206/332 |
| 4,709,808 | 12/1987 | Balduff et al. | 206/158 |
| 4,823,956 | 4/1989 | Belisle | 206/523 |
| 4,883,179 | 11/1989 | Dionne | 206/523 |
| 4,936,453 | 6/1990 | Knitter | 206/587 |
| 4,972,951 | 11/1990 | Vartanian | 206/387 |
| 5,226,543 | 7/1993 | Foos et al. | 206/592 |
| 5,385,232 | 1/1995 | Foos et al. | 206/320 |
| 5,515,976 | 5/1996 | Moren et al. | 206/586 |
| 5,545,370 | 8/1996 | Moren et al. | 264/522 |
| 5,628,402 | 5/1997 | Dickie et al. | 206/591 |

FOREIGN PATENT DOCUMENTS

| | | | |
|---|---|---|---|
| 3843990 A1 | 7/1990 | Germany | B65D 81/02 |
| 1224493 | 3/1971 | United Kingdom | B65D 25/12 |
| 2229416 | 9/1990 | United Kingdom | B65D 81/06 |

*Primary Examiner*—Jimmy G. Foster
*Attorney, Agent, or Firm*—Limbach & Limbach L.L.P.

[57] ABSTRACT

A unitary spring system end cap packaging unit, for protecting a fragile article contained within a shipping carton, including a platform portion dimensioned to support at least a portion of a shock/vibration sensitive article, and a sidewall structure. The sidewall structure includes an inner wall with a distal edge joined to the platform portion, an outer wall and at least one spring system integrally joined to a proximal edge of the inner wall and an upper edge of the outer wall. The spring system spaces the inner wall from the outer wall. The spring system includes at least one flexible harmonic bellows forming a flexible ridge that has an arcuate shape along the length of the sidewall structure. The outer wall extends below the distal edge of the inner wall so that the platform portion is supported above the lower edge of the outer wall.

36 Claims, 22 Drawing Sheets

SPRING SYSTEM END CAP FOR PACKAGING FRAGILE ARTICLES WITHIN SHIPPING CARTONS

This is a continuation-in-part application of a copending design application 29/052,650, filed on Apr. 2, 1996, abandoned.

FIELD OF THE INVENTION

The present invention relates to packaging used for shipping articles, and more particularly to flexible plastic packaging units of unitary construction for supporting and protecting a shock or vibration sensitive article inside a shipping carton.

BACKGROUND OF THE INVENTION

Shock and/or vibration sensitive articles, such as computers, monitors, TV's, VCR's, radios, computer tape and disk drives, and other sensitive electronic equipment, require special packaging when shipped inside shipping cartons. Conventional carton packaging used to protect such articles includes paper, nuggets of expanded foam, preformed polystyrene foam or beads, etc. Ideally, the packaging absorbs and dissipates shocks and vibrations impinging the shipping carton to minimize the shocks and vibrations experienced by the fragile article.

More recently, manufacturers of shock/vibration sensitive articles have developed stringent shock dissipation requirements for packaging used to ship their products. For example, some manufacturers use "drop test" requirements, which dictate the maximum amount of g force that the article packaged inside a carton can experience when the carton is dropped from a certain height. The drop test requirements typically include several g force values, depending upon which carton side, edge, and/or corner lands on the drop surface. Therefore, the carton packaging needs to adequately dissipate shocks induced from many directions.

As shock dissipation requirements become more complex, so too must the carton packaging. The performance of the carton packaging design must not only satisfy the shock dissipation requirements, but ideally should also be easily adaptable to change the shock dissipation performance since shock dissipation requirements can change for any given article, or are different from article to article.

To complicate the problem of selecting appropriate carton packaging, many articles now require protection against vibration as well. Therefore, shipping carton packaging should not only absorb shock forces to meet the above mentioned drop test requirements, but must also sufficiently absorb vibrations typically experienced by shipping cartons in transit.

Conventional carton packaging materials have proved inadequate to meet the more stringent shock and vibration absorption requirements for modern articles of commerce. In order to satisfy such requirements, large volumes of conventional carton packaging is required around the article. Voluminous packaging materials are expensive and take up excessive warehouse space before use and trash/recycling space after use. Further, larger shipping cartons are necessitated by the voluminous carton packaging, which are more expensive to purchase and to ship. The shock/vibration dissipation performance of paper, nugget and bead packaging materials can depend in large part on how the user actually packages the particular article. If a particular conventional carton packaging is deemed to provide inadequate shock/vibration protection, there is no predictable way to modify such packaging material to meet such shock/vibration dissipation requirements, except for adding more packaging material and increasing the shipping carton size.

More recently, unitary packaging structures have been developed that are made of flexible polymeric materials to allow shocks to dissipate through flexing of the structure walls. Examples of such unitary structures can be found in U.S. Pat. Nos. 5,226,543, 5,385,232, and 5,515,976. However, these unitary packaging structures are typically designed to dissipate shocks primarily in one direction and/or fail to provide adequate shock/vibration protection under the more stringent performance specifications from fragile article manufacturers. Further, such unitary packaging structure designs are not easily adaptable to predictably change their shock/vibration dissipation performance to meet new and/or changing specifications. For example, if a drop test indicates there is insufficient shock dissipation in one direction, there is no easy modification that can be made to predictably change the shock dissipation performance in that direction without unpredictably affecting shock/vibration dissipation performance in other directions.

There is a need for carton packaging that predictably meets the most stringent shock/vibration dissipation requirements without necessitating large volumes of material and/or excessively large shipping cartons. Further, there is a need for such carton packaging to be easily modifiable to predictably meet a wide range of shock/vibration dissipation requirements, and changes to those requirements. Lastly, there is a need for such carton packaging to use minimal storage space before and after use, and to use minimal packaging material to reduce cost and shipping weight.

SUMMARY OF THE INVENTION

The present invention solves the aforementioned problems by providing a light, inexpensive unitary spring system end cap packaging structure that efficiently dissipates shocks and vibrations while using a minimal amount of carton space during use, and a minimal amount of storage space before and after use. The present invention has a design that is easily adapted to meet a wide range of the most stringent shock/vibration dissipation requirements without using voluminous amounts of material.

The unitary spring system end cap of the present invention includes a platform portion dimensioned to support at least a portion of a shock/vibration sensitive article, and a sidewall structure. The sidewall structure includes an inner wall having proximal and distal edges, where the distal edge is joined to the platform portion, an outer wall having upper and lower edges, and at least one spring system integrally joined to the proximal edge of the inner wall and the upper edge of the outer wall. The spring system spaces the inner wall from the outer wall. The spring system includes at least one flexible harmonic bellows forming a flexible ridge that has an arcuate shape along the length of the sidewall structure. The outer wall extends below the distal edge of the inner wall so that the platform portion is supported above the lower edge of the outer wall.

Other objects and features of the spring system end caps of the present invention will become apparent by a review of the specification, claims and appended figures.

DETAILED DESCRIPTION OF THE PREFERRED EMBODIMENTS

Figure 1A:
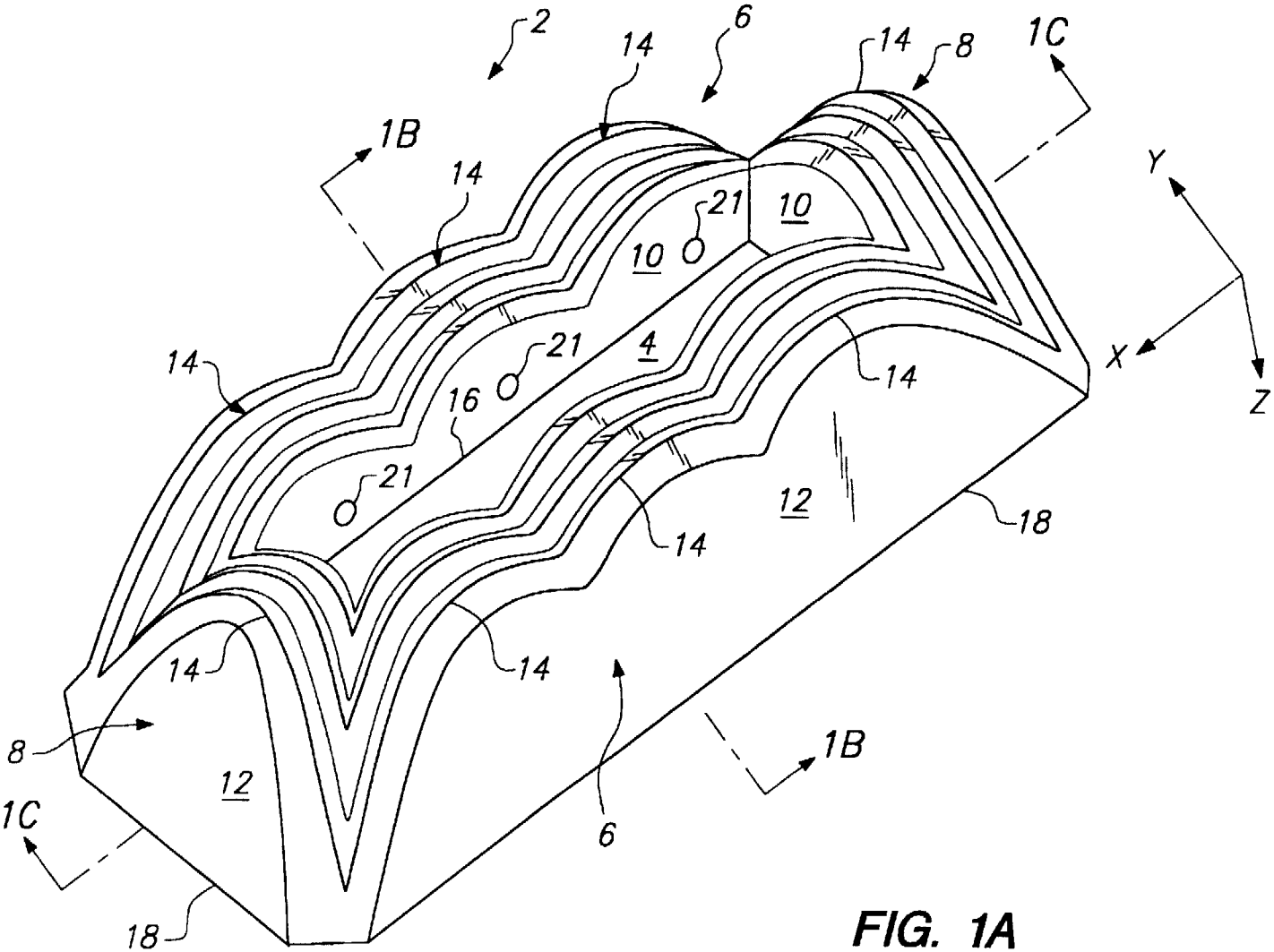
FIG. 1A is a perspective view of the spring system end cap of the present invention.
Figure 1B:
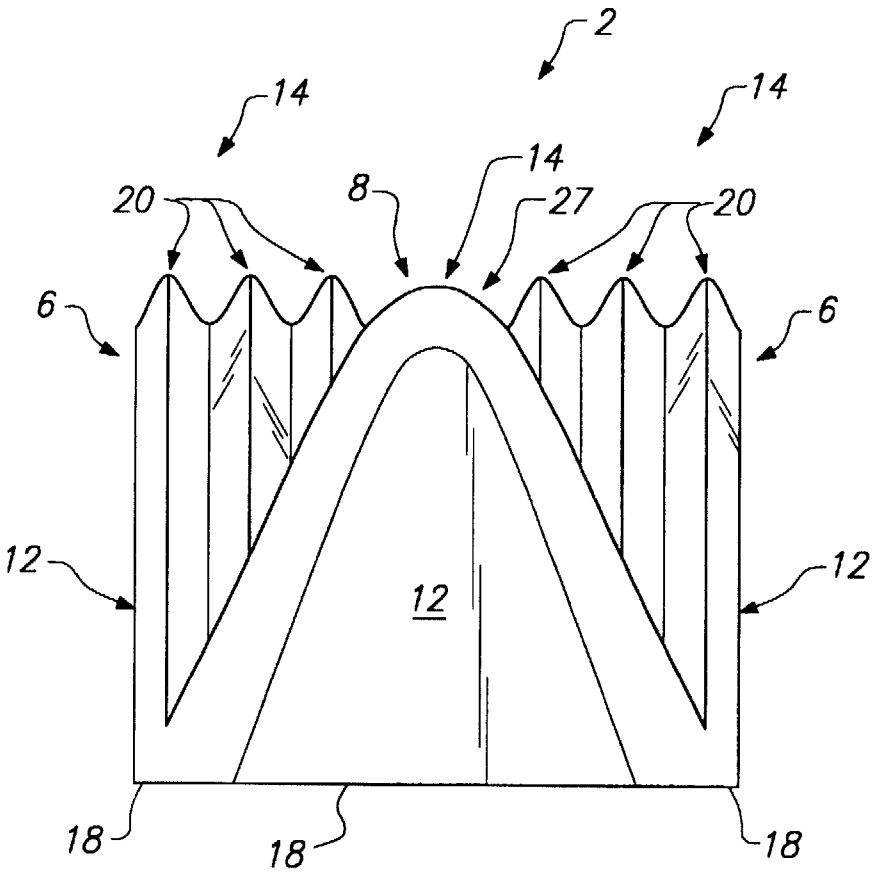
FIG. 1B is an end view of the spring system end cap of the present invention.
Figure 1C:
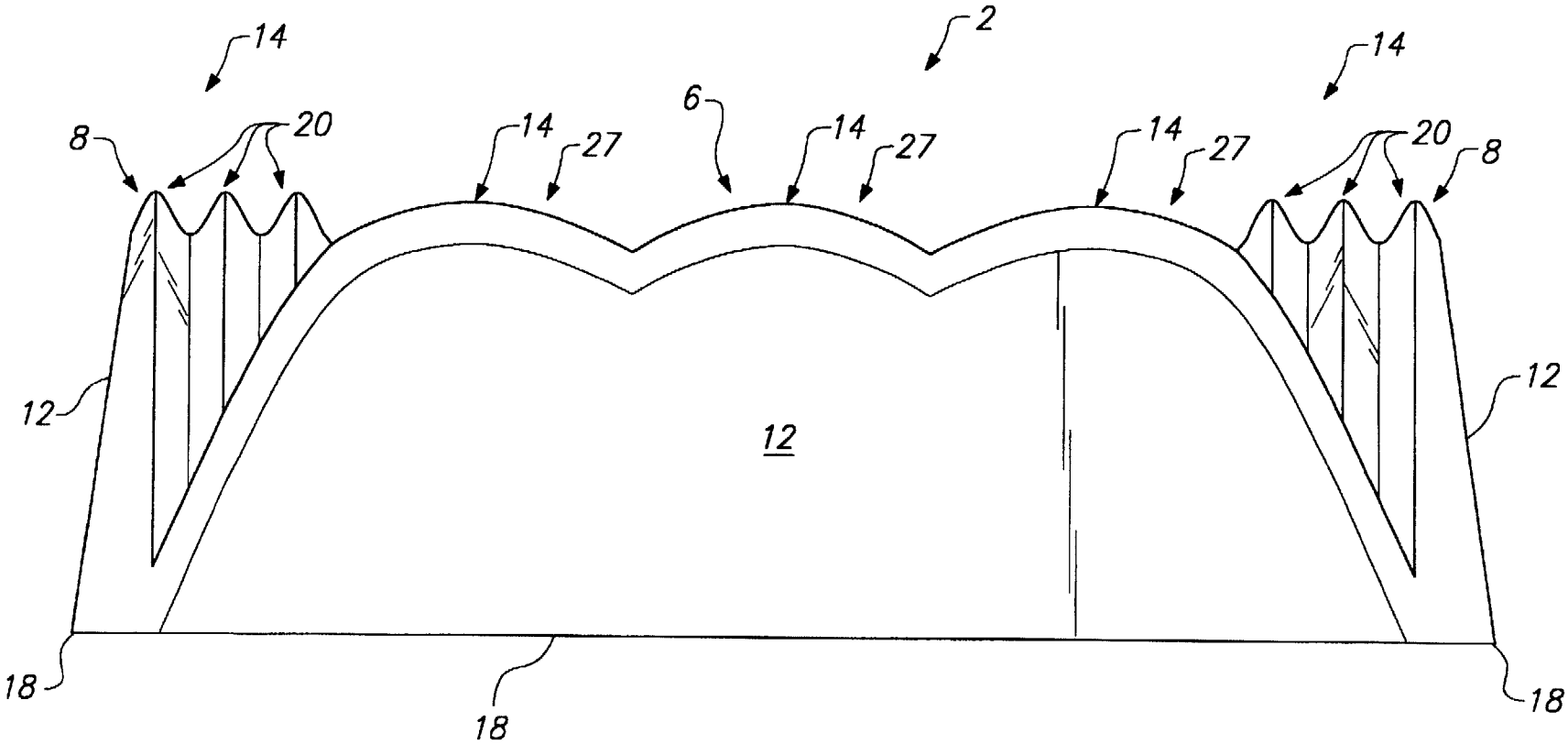
FIG. 1C is a side view of the spring system end cap of the present invention.
Figure 1F:
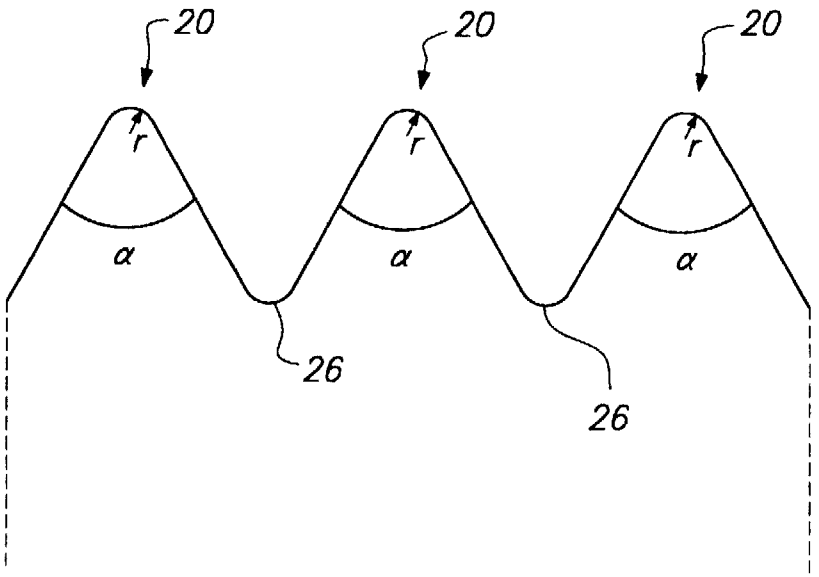
FIG. 1F is a cross-sectional end view of a sidewall structure illustrating the radius of curvature of the top of the ridges of the harmonic bellows.
Figure 1D:
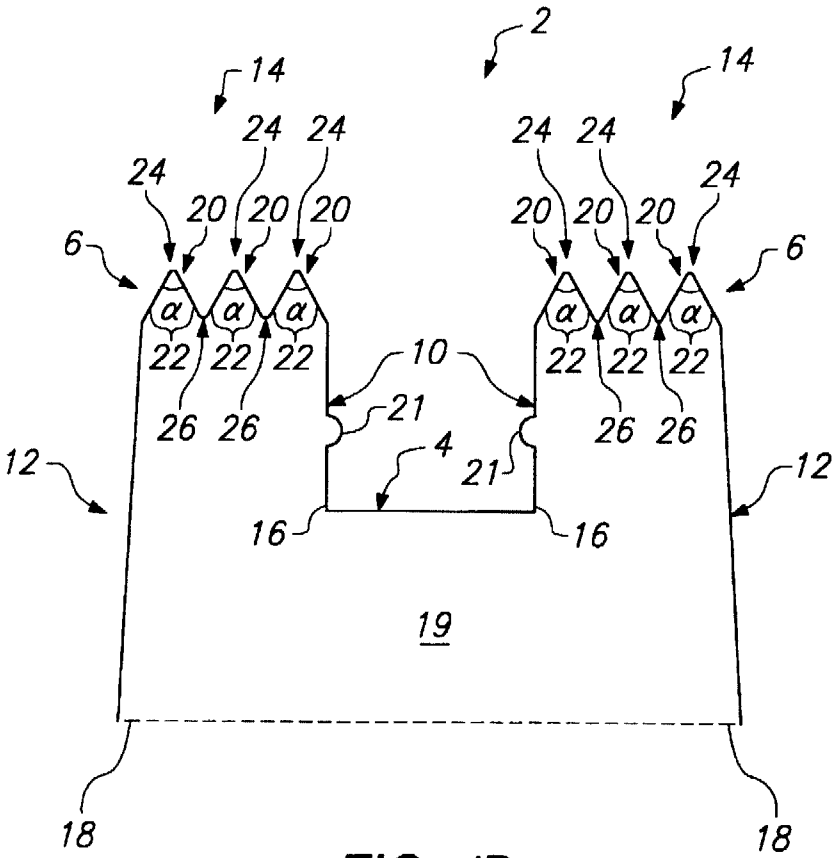
FIG. 1D is a cross-sectional end view of the spring system end cap of the present invention illustrating the harmonic bellows in the sidewall structures.
Figure 1E:
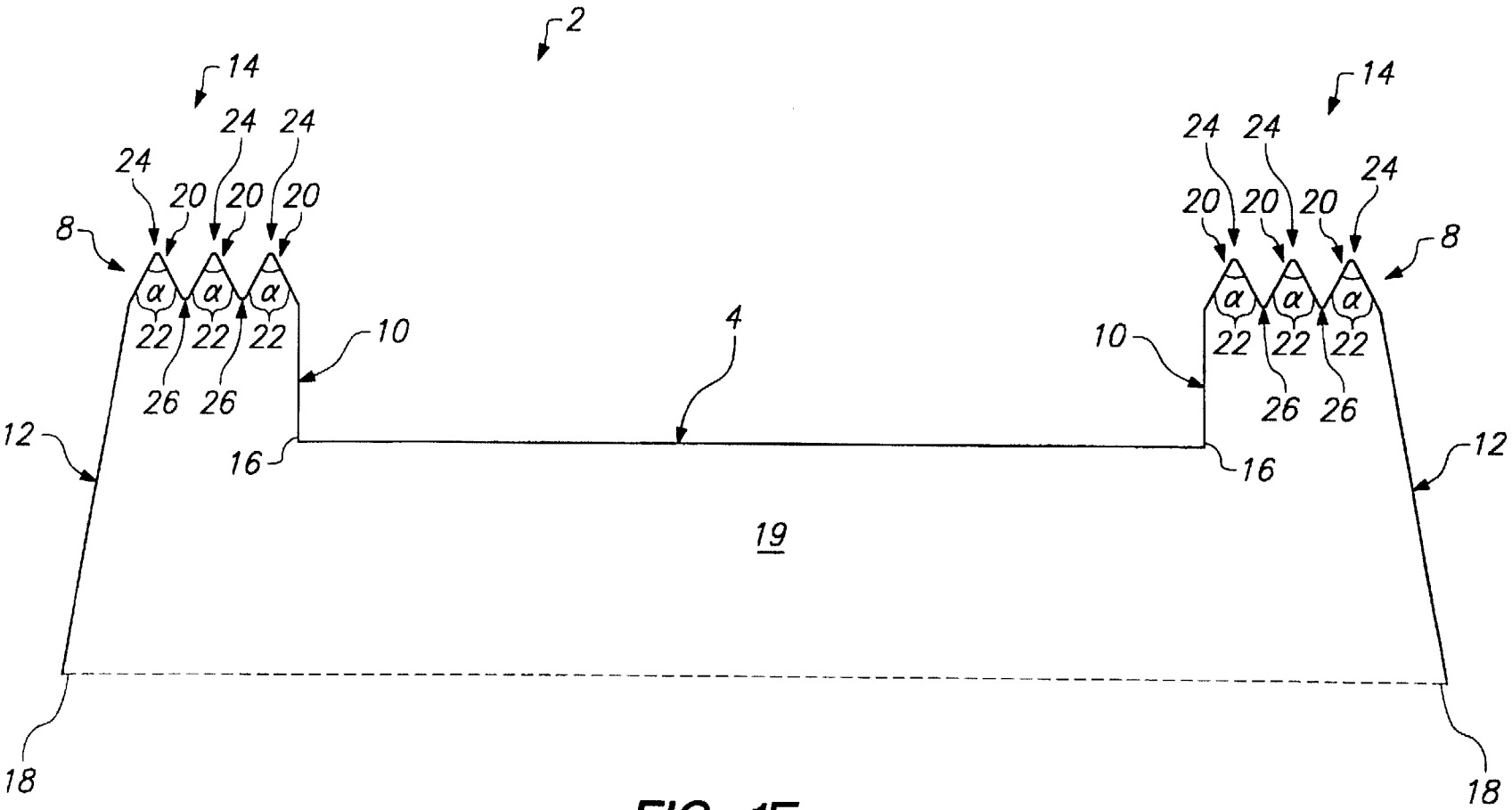
FIG. 1E is a cross-sectional side view of the spring system end cap of the present invention illustrating the harmonic bellows in the sidewall structures.

The present invention is a multiple spring system end cap packaging structure of unitary construction for supporting and protecting a shock/vibration sensitive article inside a shipping carton by dissipating shocks and vibrations experienced by the carton using a plurality of spring systems. The spring system end caps are nestable for space efficient storage before and after use, utilize minimal carton space to dissipate such shocks and vibrations, are lightweight, and have a structural design that can be easily modified to predictably meet a wide range of shock/vibration dissipation requirements.

The preferred embodiment of the spring system end cap 2 of the present invention is illustrated in FIGS. 1A–1F, and includes a platform 4 supported by sidewall structures 6 and 8.

The sidewall structures 6/8 each include an inner wall 10 and outer wall 12 which are connected together by one or more spring systems 14. The lower edge 16 of the inner walls 10 joins with and supports platform 4. The outer walls 12 extend below platform 4 to define a cushion space 19 (shown in FIG. 1E) between the lower edge 18 of outer walls 12 and platform 4. Dimples 21 are formed protruding from inner walls 10 to create a friction fit between the article and the inner walls 10. Each spring system 14 includes one or more parallel arced harmonic bellows 20 extending along the length of each sidewall structure 6/8. Bellows 20 are each formed by two elastic plates 22 attached together at an angle $\alpha$ to form a ridge 24 with a cross-sectional radius of curvature r. Ridges 24 extend in, and have an arcuate shape in, the longitudinal (lengthwise) direction of sidewall structures 6/8 to form arcs 27. If a spring system 14 contains more than one harmonic bellows 20, the bellows 20 are formed side by side with the bottom edges of elastic plates 22 from adjacent .bellows 20 being joined together to form a channel 26 between the ridges 24. Channel 26 also extends in, and has an arcuate shape in, the longitudinal (lengthwise) direction of sidewall structures 6/8. If a sidewall structure 6/8 has more than one spring system 14, the ridges from the spring systems 14 are formed end to end resulting in a plurality of arcs 27 connected end to end along the length of that sidewall structure 6/8.

For each spring system 14, the innermost elastic plate 22 joins with the inner wall 10, and the outermost elastic plate 22 joins with the outer wall 12. The embodiment illustrated in FIGS. 1A-1F includes sidewall structures 6 having three spring systems 14 each with three harmonic bellows 20, and sidewall structures 8 having one spring system 14 with three harmonic bellows 20.

Figure 2:
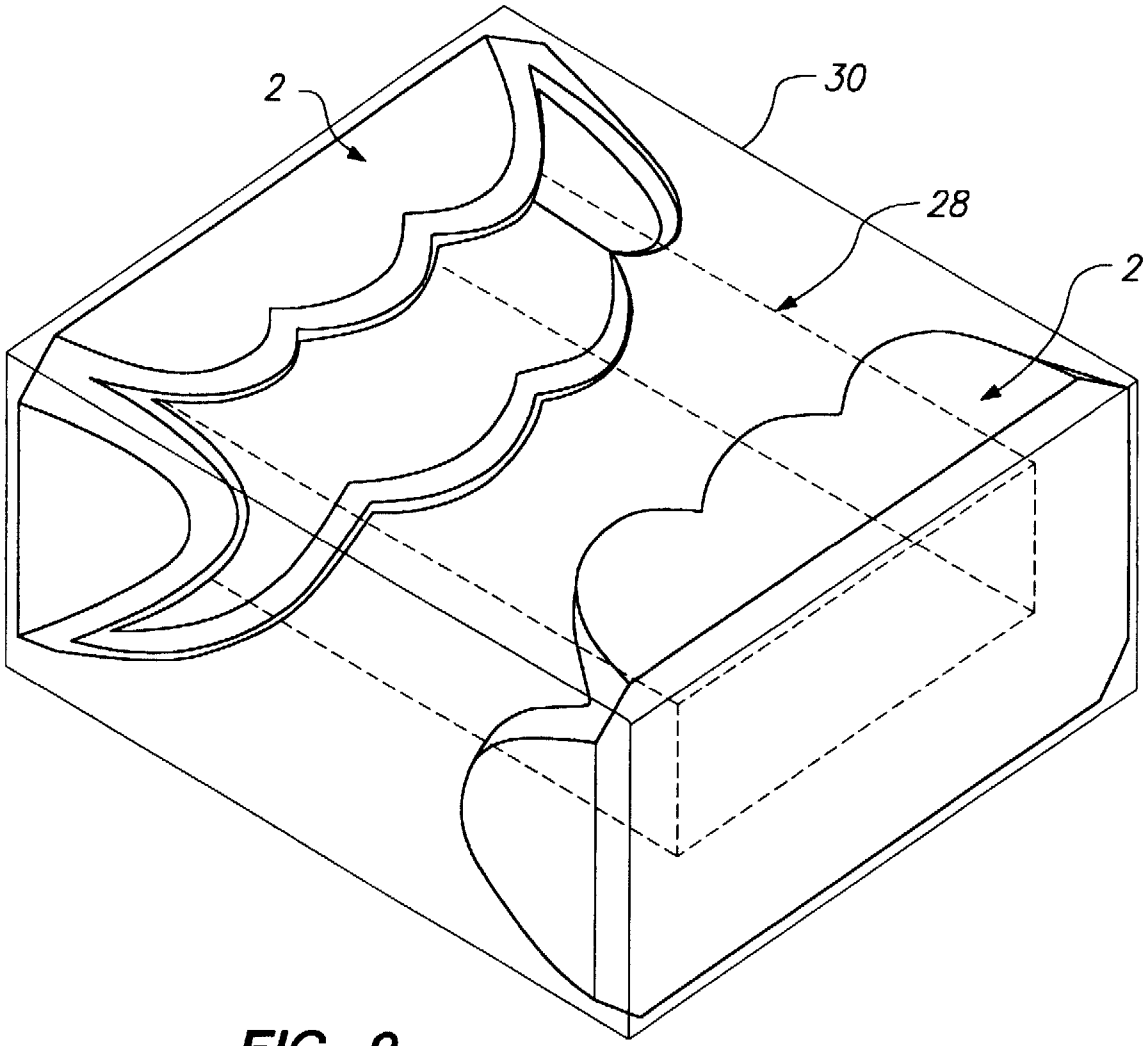
FIG. 2 is a perspective view of a shock sensitive article supported by a pair of spring system end caps within a shipping carton.

FIG. 2 illustrates the manner in which a pair of end caps 2 support a fragile article 28 inside a shipping carton 30. The end caps 2 support opposing ends of the article via the inner walls 10 and platform 4. The end caps 2 are supported inside the shipping carton by outer wall lower edges 18 and outer walls 12, which abut the inside surfaces of the shipping carton 30. The above described end caps 2 provide optimal deceleration of the article supported thereby when an external shock force is applied to the shipping carton, as described below.

Figure 3B:
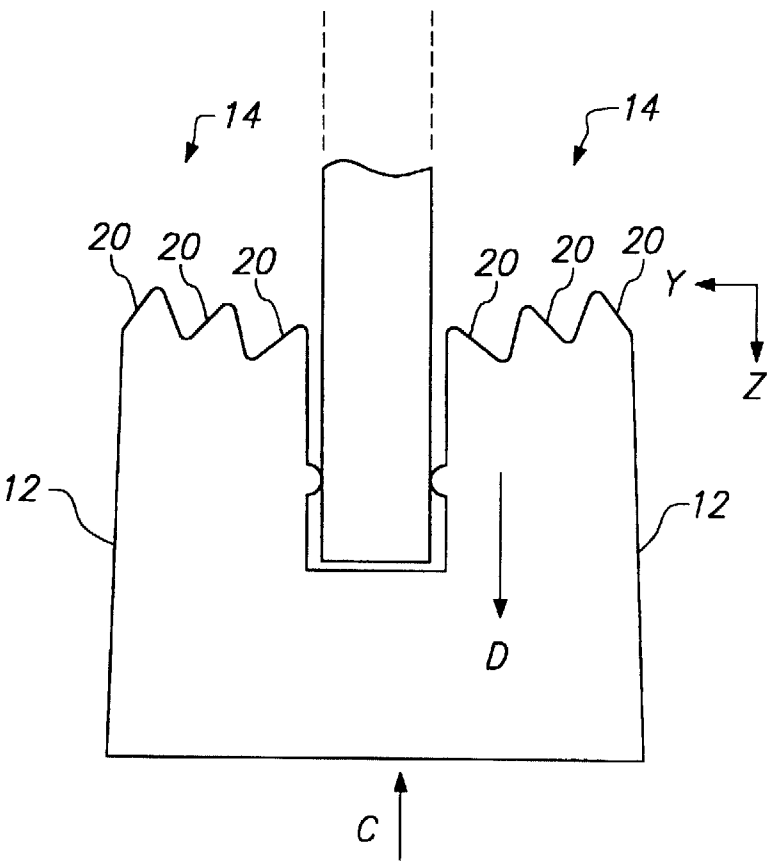
FIG. 3B is a cross-sectional end view of the spring system end cap of the present invention illustrating the compression/expansion of the harmonic bellows upon vertical displacement of the platform.
Figure 3A:
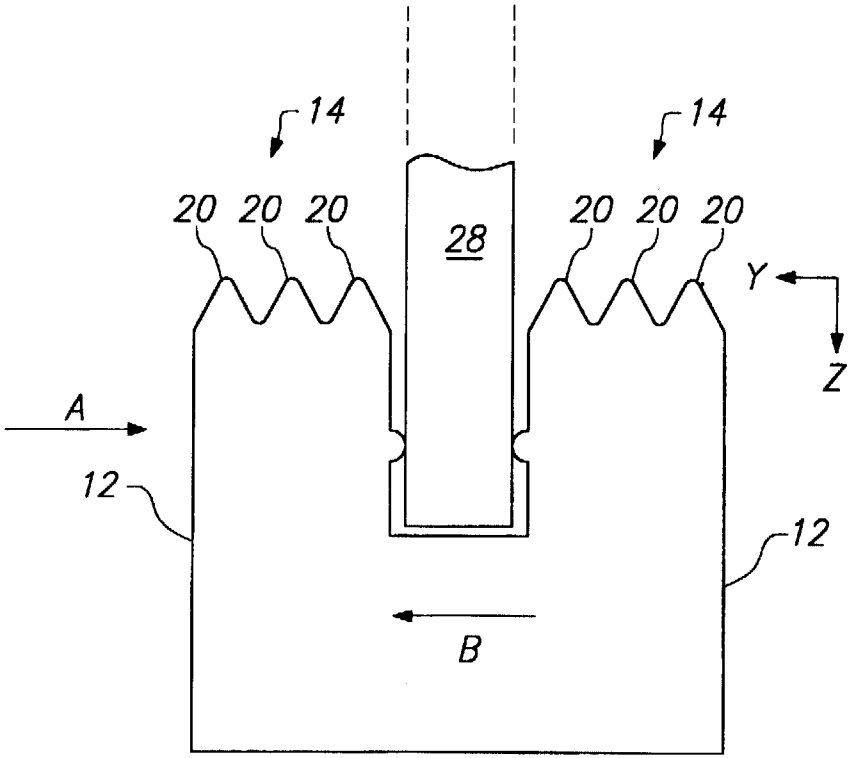
FIG. 3A is a cross-sectional end view of the spring system end cap of the present invention illustrating the compression/expansion of the harmonic bellows upon horizontal displacement of the platform.

Shock forces impinging the shipping carton and translated to each end cap 2 can be broken down into two horizontal components X and Y, and one vertical component Z, as illustrated in FIGS. 1A, 3A and 3B. The horizontal components of any shock force or vibration are dissipated by the sidewall structures 6/8 by inducing a stretching and compression of the harmonic bellows 20. FIG. 3A illustrates a Y component force and its effects on sidewall structures 6. A shock force in the direction of arrow A causes the platform 4 to displace in direction of arrow B, which causes the harmonic bellows 20 on the left of the platform 4 to compress together, and the bellows 20 on the right of the platform 4 to expand. During such bellows compression/expansion, the material that forms the ridges 24 and the channels 26 is stressed, thus absorbing the energy of the force. After the energy of the shock is absorbed by harmonic bellows 20, the bellows 20 on the left of the platform 4 resiliently expand and the bellows 20 on the right of platform 4 resiliently contract back to their natural uncompressed/ unexpanded form, thus restoring the platform 4 to its original position. A similar bellows compression/expansion occurs for platform displacements in the direction of arrow A, as well as in sidewall structures 8 for X component forces. Vibrations are also similarly absorbed by sidewall structures 6/8, but with only minimal platform displacement in the X and Y axes.

The vertical components of any shock force or vibration are dissipated by the both sidewall structures 6 and 8, as illustrated in FIG. 3B. A shock force in the direction of arrow C causes the platform 4 to displace in direction of arrow D, which in turn causes the harmonic bellows 20 in both sidewall structures 6/8 to rock inward and expand toward platform 4 while outer wall 12 deflects inwardly. The material that forms the ridges 24 and the channels 26 is stressed, thus absorbing the energy of the force. After the energy of the shock is absorbed by harmonic bellows 20, the bellows 20 resiliently contract back to their natural unexpanded form, thus restoring the platform 4 to its original position. The corners of the end caps 2 are formed so that when all the bellows 20 rock inwardly, the bellows 20 on either side of each corner do not interfere with each other during the downward deflection of the platform 4. A similar bellows compression/expansion occurs for platform displacements in the direction of arrow C (to the extent that the article can pull up on inner walls 10). Vibrations are also similarly absorbed by sidewall structures 6/8, but with only minimal platform displacement in the Z axes.

It should be noted that spring systems 14 in the sidewall structures 6 can be made to operate more independently from spring systems 14 in the sidewall structures 8 by making the bellows thicknesses on either side of the corners equal. This will ensure the least amount of operational interference across the end cap corners.

Each bellows 20 of each spring system 14 operates independently during a shock or vibration. Therefore, if a shock force has both horizontal and vertical (X, Y, and Z) components, then each spring system 14 works independently to absorb the energy of that shock force.

The arcuate shape of the bellows 20 provides superior strength along the length of each sidewall structure 6/8, and prevents the bellows 20 from buckling during large deflections of the platform 4.

The maximum g force and vibration experienced by the article is dictated by the overall stiffness of the end cap 2 in the direction of the force/vibration. If the spring systems 14 are too soft, then the bellows 20 will completely collapse together so the platform will hit the outer wall 12, and/or the platform 4 will be deflected beyond outer wall lower edge 18 to contact the side of the shipping carton, either of which will increase the maximum force experienced by the article. If the spring systems 14 are too stiff, then the bellows 20 will not sufficiently compress and expand to absorb and dissipate a sufficient amount energy from the shock or vibration, which will also increase the maximum force/vibration experienced by the article. Therefore, each spring system 14 needs to have a certain stiffness, so the overall stiffness of the end cap 2 in any given direction will result in the maximum amount of shock/vibration absorption and dissipation, without the platform contacting the outer walls 12 or the shipping carton.

The overall end cap stiffness in any given direction is a function of a number of end cap design parameters. Generally, overall end cap stiffness is increased by increasing, either individually or in combination, any of the following end cap design parameters: the number of spring systems 14 in each sidewall structure 6/8 (i.e. the number of arcs 27), the radius of curvature of the spring system arcs 27, the number of bellows 20 in each spring system 14, the ridge angles $\alpha$ between the elastic plates 22 of the various bellows 20, the cross-sectional radius of curvature r of the ridge, the length of the elastic plates 22, and the flexibility/thickness of the material used to form the end cap 2. Also, decreasing the area of the platform 4 can increase stiffness for vertical platform deflections because the inner walls 10 better engage the article to resist the bellows 20 from rotating inwardly during platform deflection. In addition, increasing the cushion space 19 will provide additional distance for platform displacement, thus preventing the platform 4 from contacting the sides of the shipping carton. It should be noted that these end cap design parameters can differ from sidewall structure to sidewall structure, spring system to spring system, and even from bellows to bellows within the same spring system.

Each of the above design parameters can be individually adjusted to provide the desired end cap stiffness in any given direction, and at any location in end cap 2. Therefore, if a particular end cap design satisfies most of the shock/vibration dissipation requirements, it is easy to predict what end cap design parameters need adjusting to achieve those remaining requirements not yet satisfied. Further, the end cap design can be customized to provide different stiffness support for different portions of the article. For example, if an article is heavier at one end of the platform 4 than the other, then the spring systems 14 near the heavier end can be designed to accommodate the extra weight (i.e. by changing the ridge angles $\alpha$ on one or more the bellows 20 closest to that heavy end, or by adding an extra bellows 20 to those spring systems 14 supporting the heavy end, etc.). Each spring system 14 can have a unique stiffness, and each bellows 20 within that spring system 14 can embody different end cap design parameter values to achieve that unique stiffness. Because these design parameters operate relatively independently and predictably upon the stiffness of the end cap, these design parameters can be changed individually to fine tune the performance of the end cap to meet any given shock/vibration absorption requirement.

The preferred material used to make end cap 2 is high density polyethylene because it is has good tensile and tear properties at low temperatures as well as being recyclable.

Other materials that can be used to make the end cap 2 include: polyvinyl chloride, polypropelene, low density polyethylene, PETG, PET, styrene, and many other polymeric materials.

The spring system end caps of the present invention are fully nestable for efficient stackability to minimize storage space before and after use. Further, because of the resiliency of the end cap 2 material and spring system design, these end caps can be re-used repeatedly. The bellows design of the end caps results in minimal space requirements inside the carton for maximum cushion effect, thus reducing the carton size needed to safely ship any given article. End caps 2 are also lightweight to minimize shipment costs both of the end caps before use, as well as during shipment of the articles utilizing the end caps.

Figure 4A:
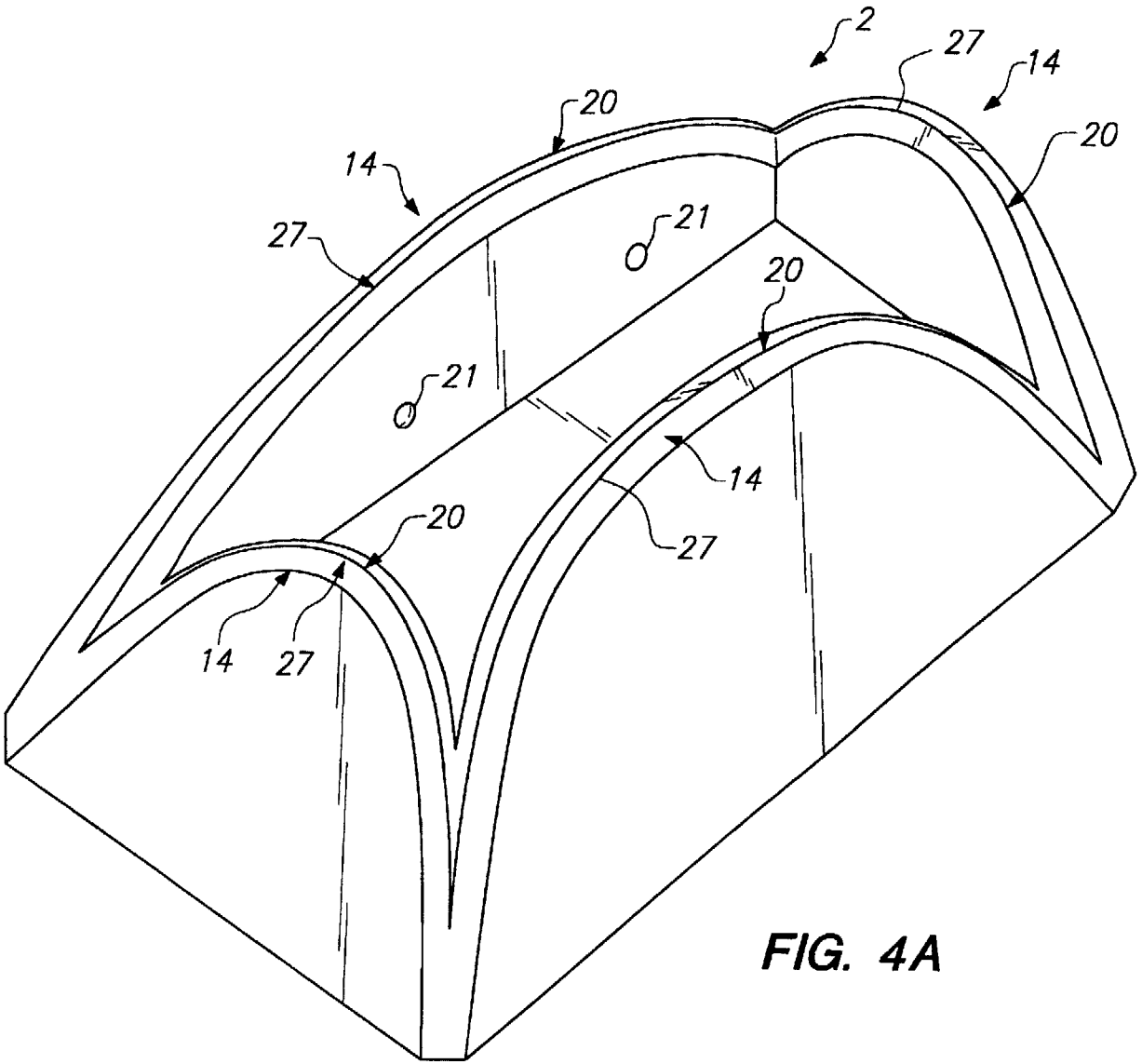
FIG. 4A is a perspective view of a first alternate embodiment of the spring system end cap of the present invention.
Figure 4B:
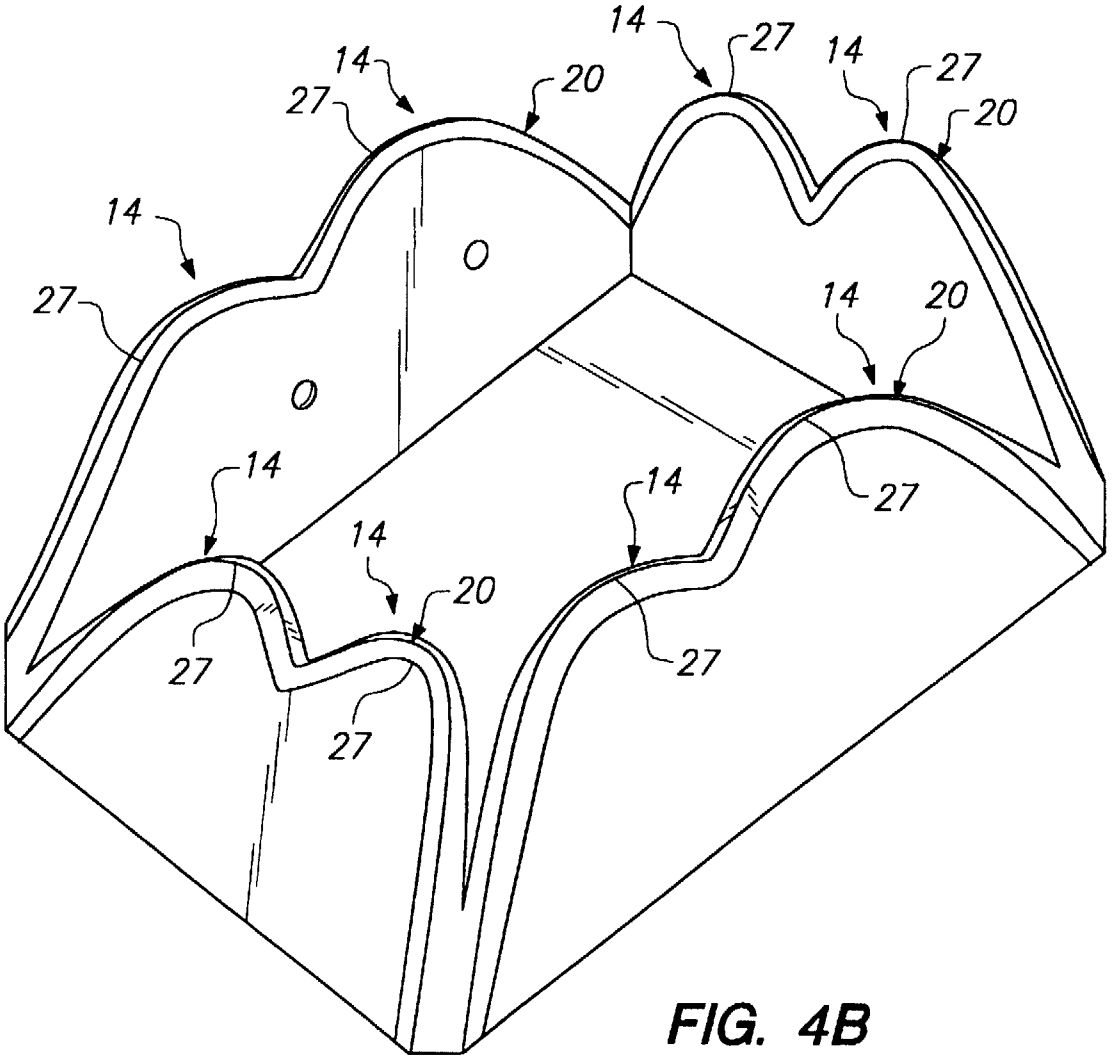
FIG. 4B is a perspective view of a second alternate embodiment of the spring system end cap of the present invention.
Figure 4C:
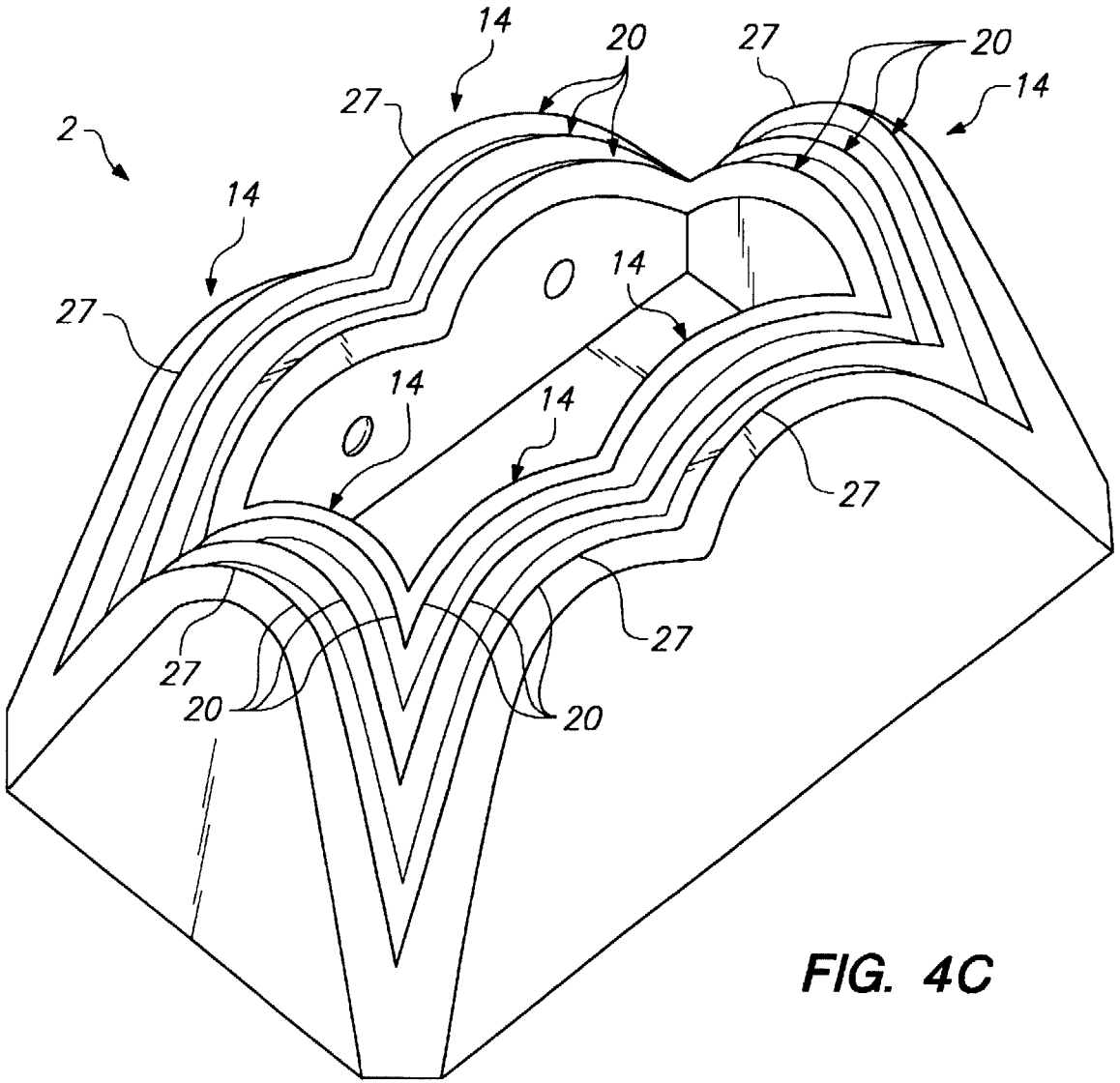
FIG. 4C is a perspective view of a third alternate embodiment of the spring system end cap of the present invention.
Figure 4D:
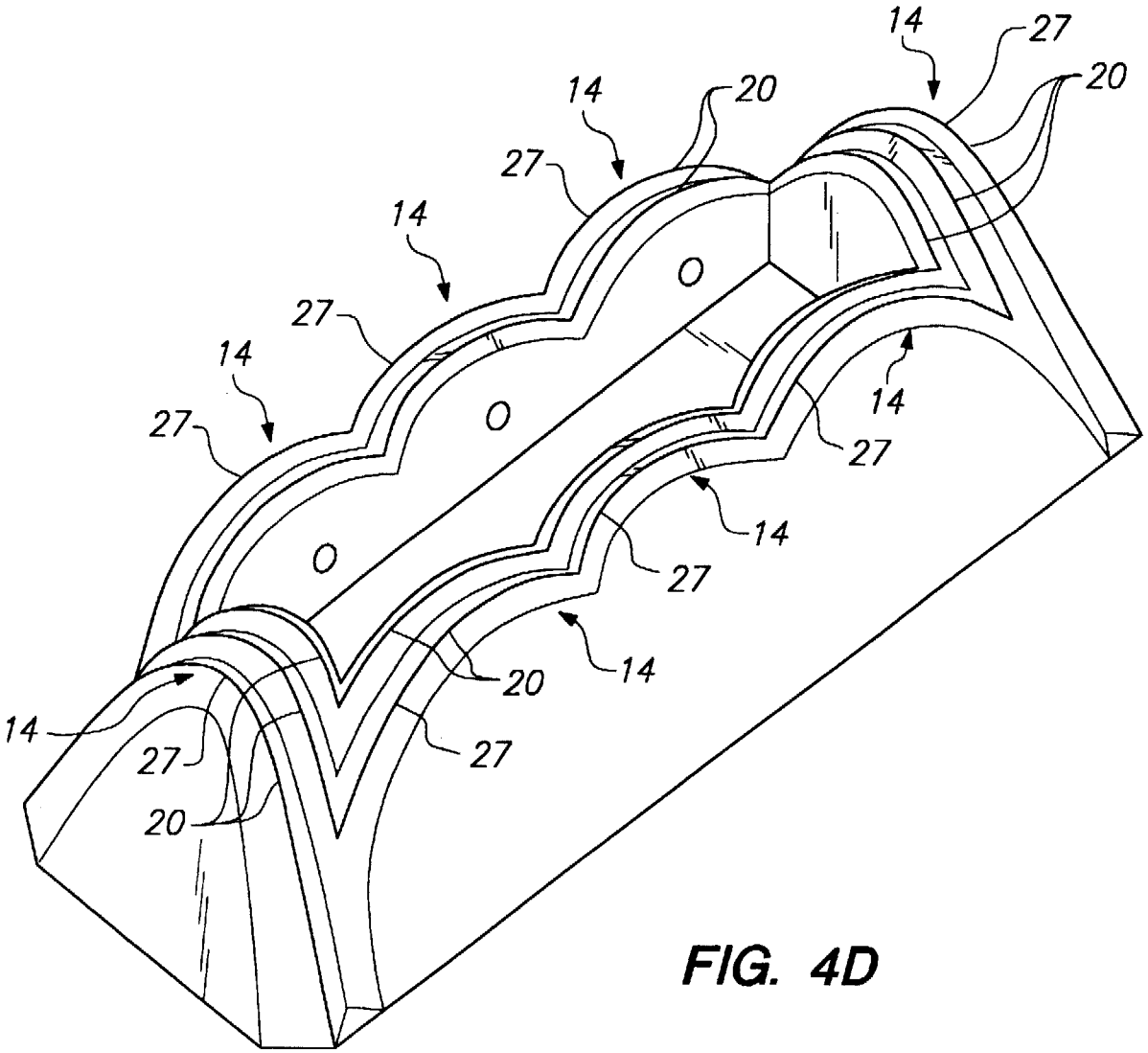
FIG. 4D is a perspective view of a fourth alternate embodiment of the spring system end cap of the present invention.
Figure 4E:
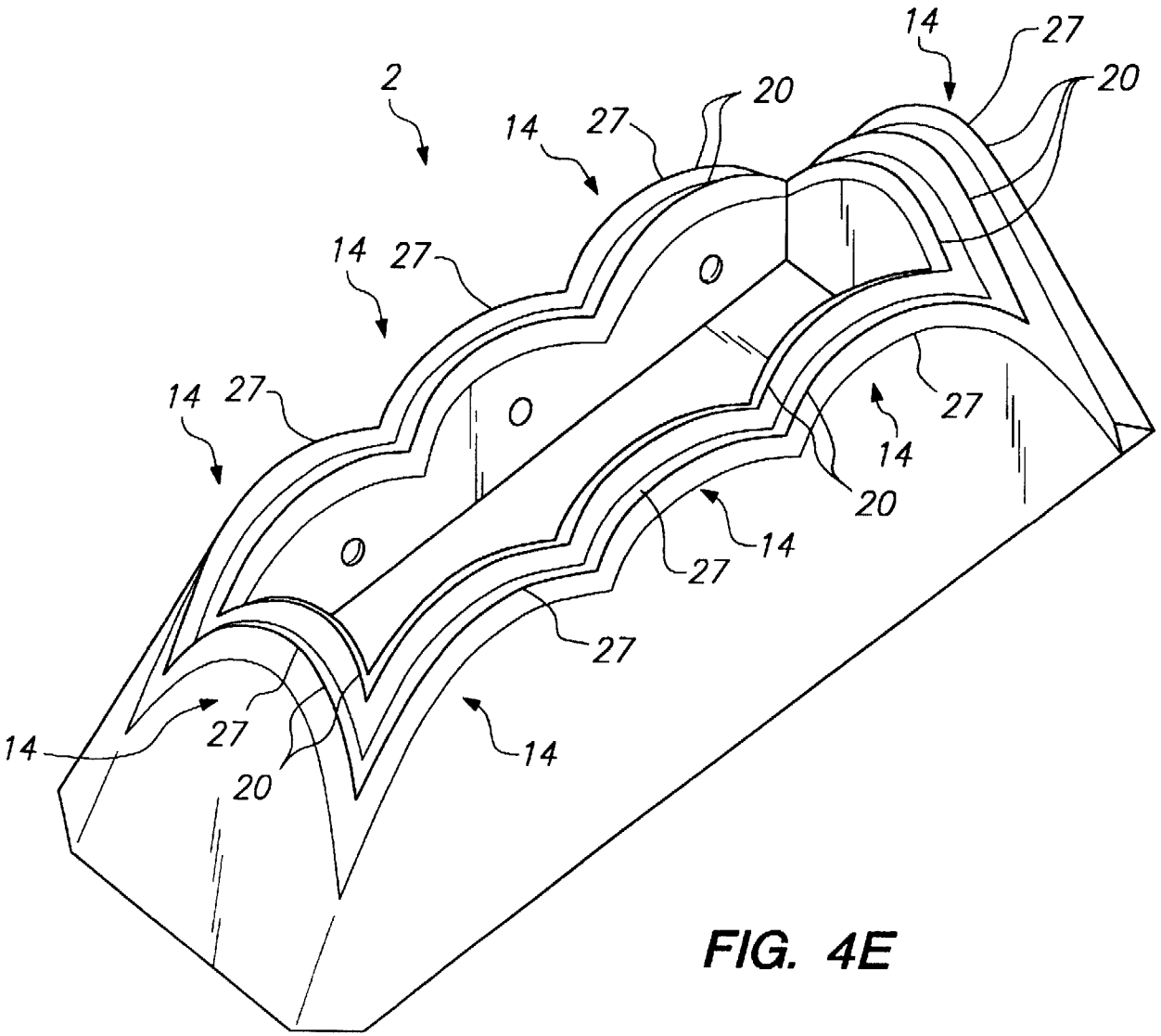
FIG. 4E is a perspective view of a fifth alternate embodiment of the spring system end cap of the present invention.
Figure 4F:
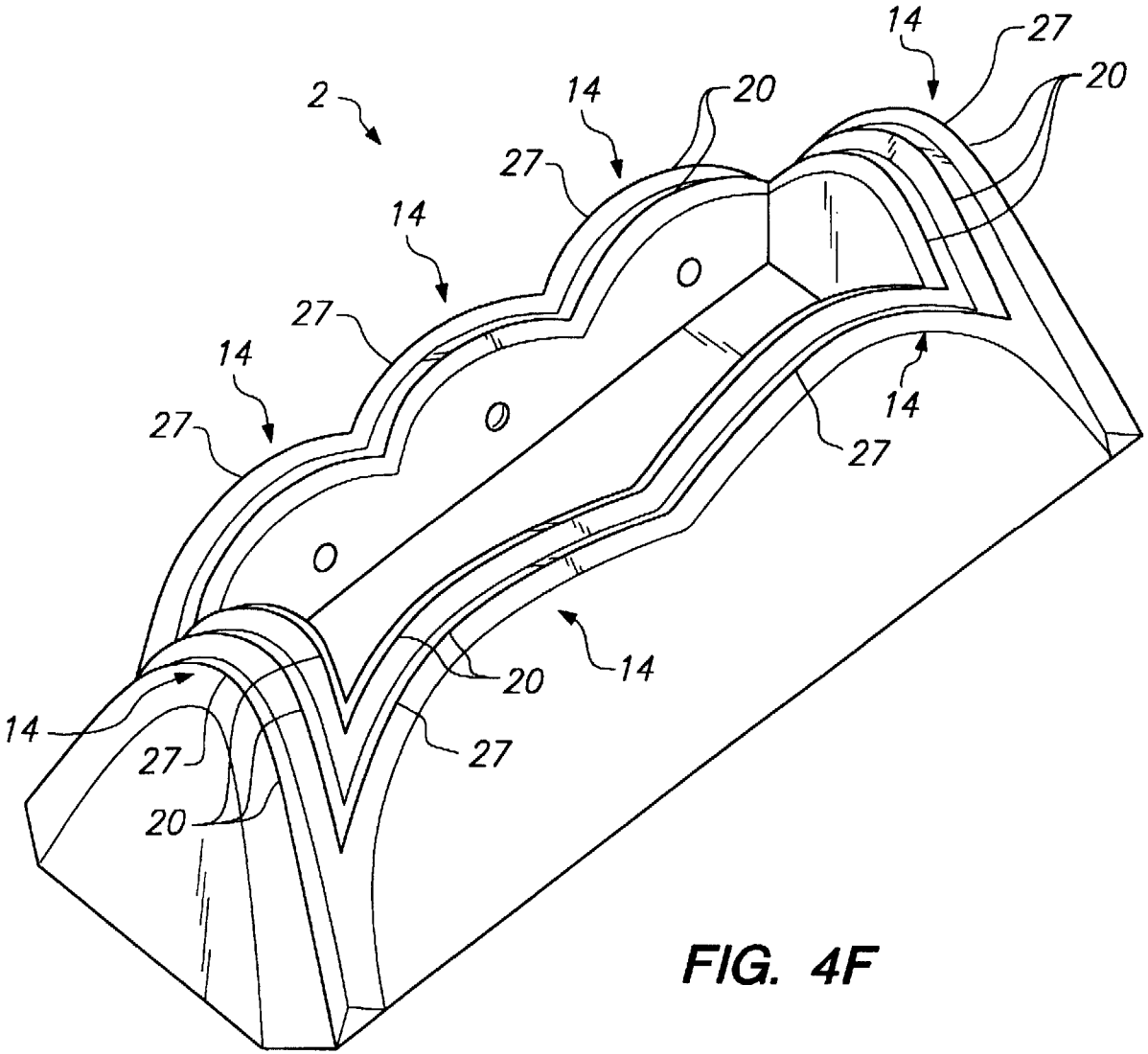
FIG. 4F is a perspective view of a sixth alternate embodiment of the spring system end cap of the present invention.
Figure 4H:
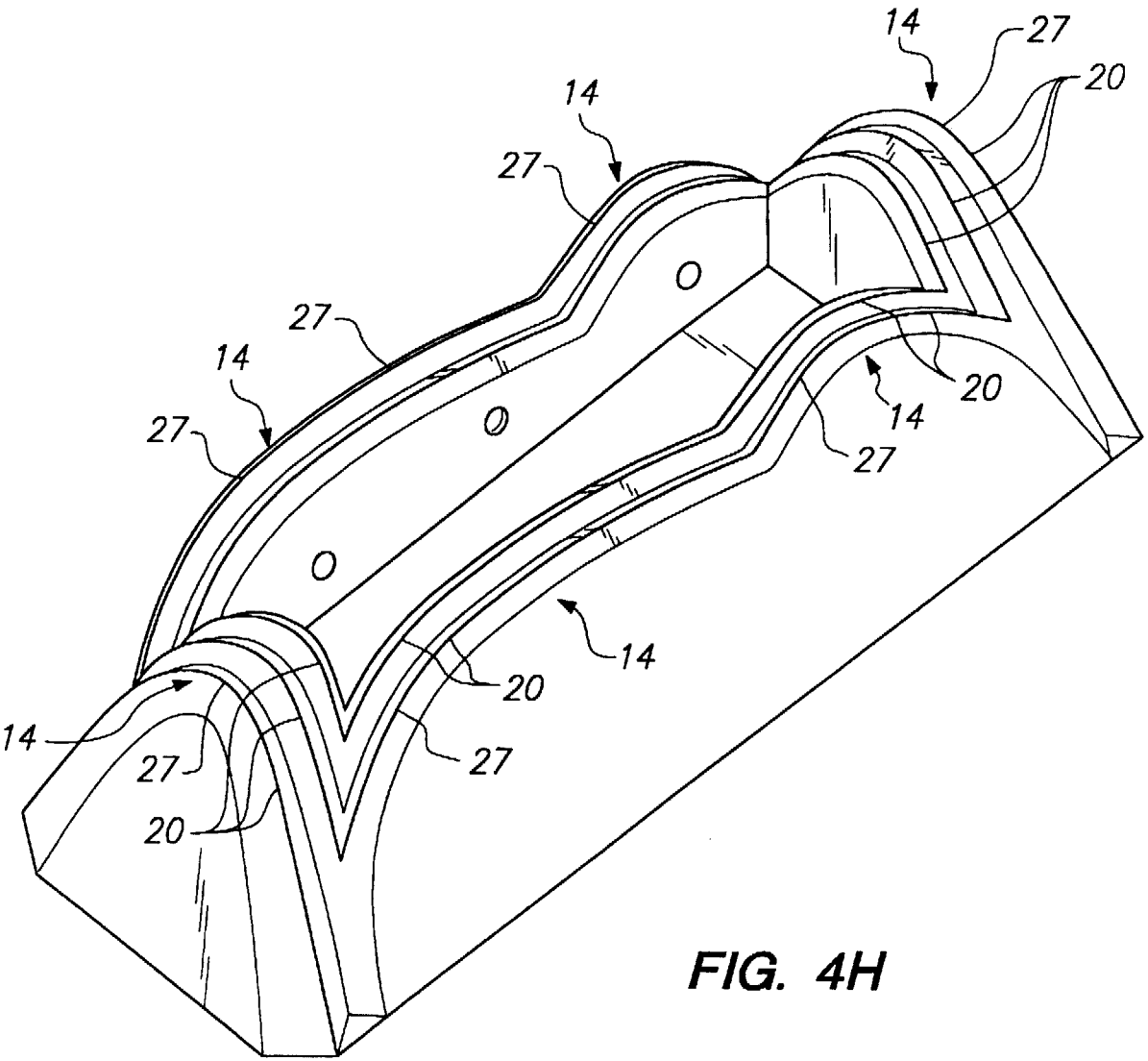
FIG. 4H is a perspective view of an eighth alternate embodiment of the spring system end cap of the present invention.
Figure 4G:
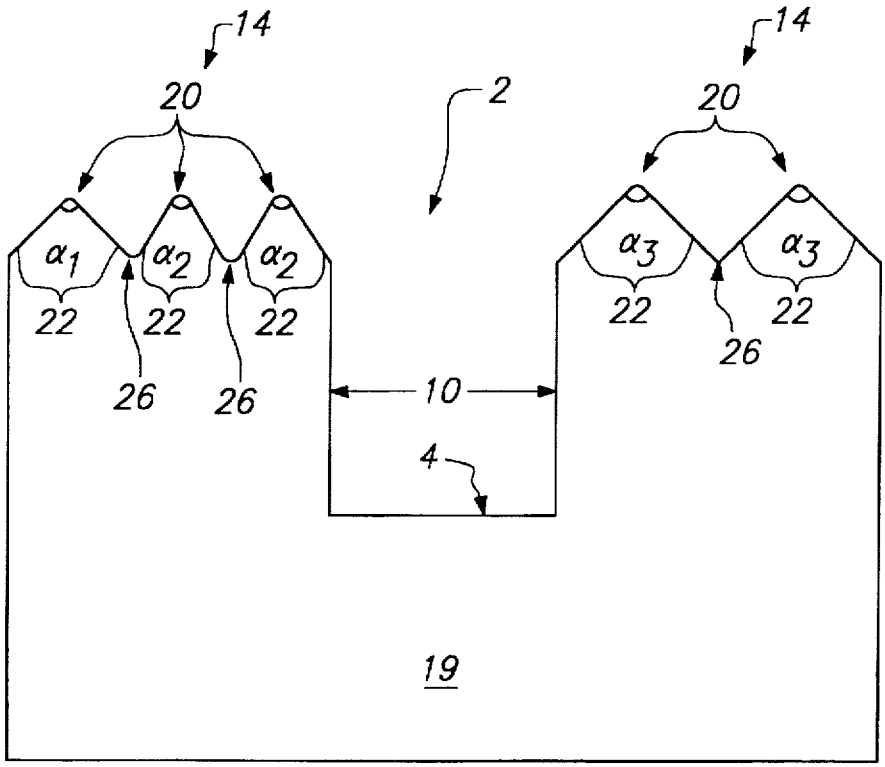
FIG. 4G is a cross-sectional end view of a seventh alternate embodiment of the spring system end cap of the present invention.
Figure 4I:
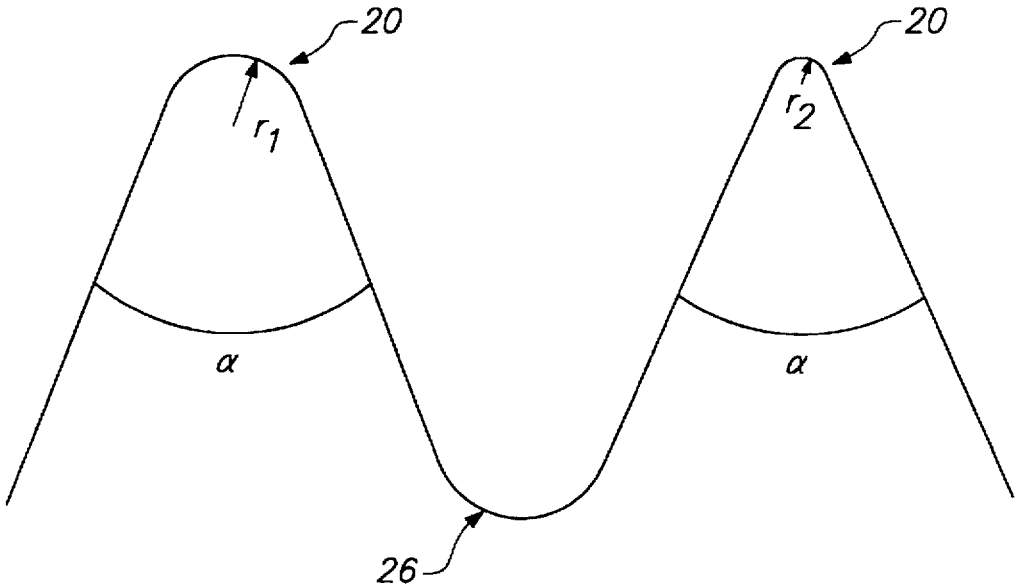
FIG. 4I is a cross-sectional end view of a ninth alternate embodiment of the spring system end cap of the present invention.
Figure 4J:
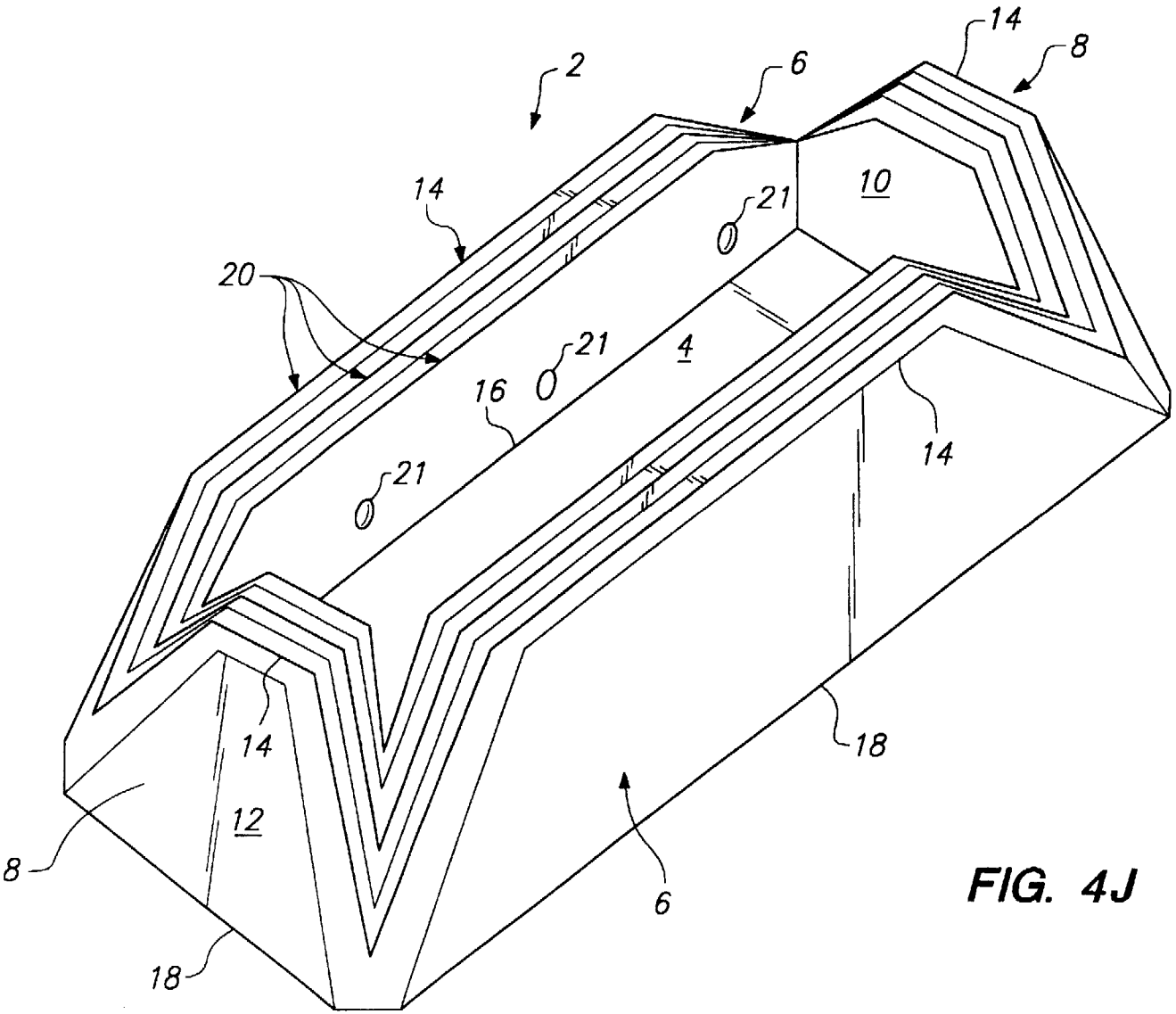
FIG. 4J is a perspective view of a tenth alternate embodiment of the spring system end cap of the present invention.
Figure 6C:
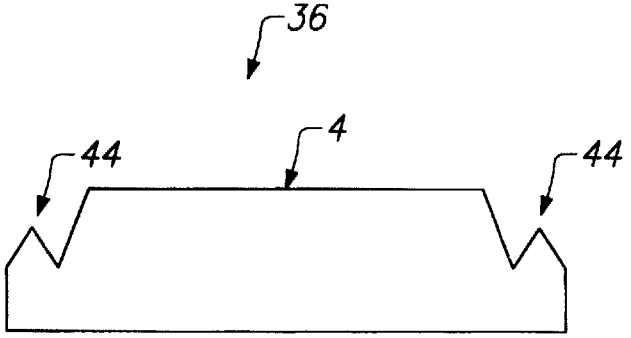
FIGS. 6C and 6D are cross-sectional side views of the eleventh alternate embodiment of the spring system end cap of the present invention.
Figure 6D:
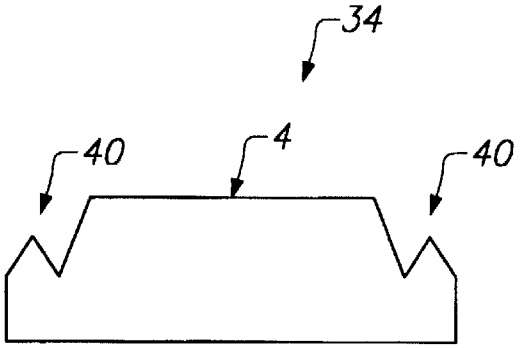
Figure 4K:
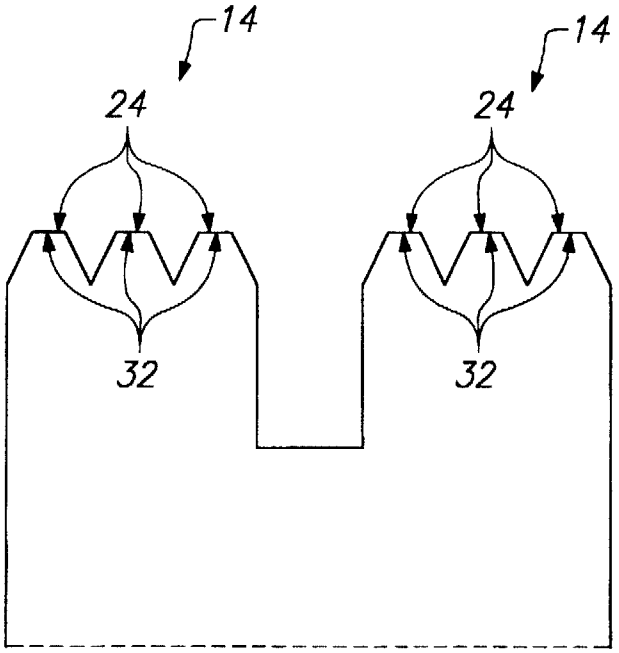
FIG. 4K is a cross-sectional end view of an eleventh alternate embodiment of the spring system end cap of the present invention.

FIGS. 4A to 4H illustrate various embodiments of the present invention, utilizing different combinations of some of end cap design parameter values discussed above. For example, FIG. 4A illustrates an end cap 2 with one spring system 14 per sidewall structure 6/8, and one bellows 20 per spring system 14. FIG. 4B illustrates an end cap 2 with a plurality of spring systems 14 per sidewall structure 6/8, and one bellows 20 per spring system 14. FIG. 4C illustrates an end cap 2 with two spring systems 14 per sidewall structure 6 and one spring system 14 per sidewall structure 8, and a plurality of bellows 20 per spring system 14. FIG. 4D illustrates an end cap 2 where the sidewall structures 8 have more bellows 20 but fewer spring systems 14 than the sidewall structures 6. FIG. 4E illustrates an end cap 2 with one sidewall structure 8 having more bellows 20 than the other sidewall structure 8. FIG. 4F illustrates an end cap 2 with one sidewall structure 6 having more spring systems 14 than the other sidewall structure 6. FIG. 4G illustrates an end cap 2 with one sidewall structure 6 having different ridge angles $\alpha$, plate lengths, and number of harmonic bellows 20 than the other sidewall structure 6. FIG. 4H illustrates an end cap 2 with sidewall structures 6 containing spring systems 14 having arcs 27 of different radius' of curvature. FIG. 4I illustrates an end cap 2 with a sidewall structure 6 having one ridge (with a cross-sectional radius of curvature $r_1$) that is stiffer than an adjacent ridge (with a cross-sectional radius of curvature $r_2$) because $r_1>r_2$. FIG. 4J illustrates an end cap 2 with flat ridges (no arcs) but a plurality of harmonic bellows 20 in each sidewall structure 6/8. FIG. 4K illustrates ridges 24 with a flat top portion 32.

As made evident from FIGS. 4A–4K, the present invention embodies spring system end cap designs that include any combination of end cap design parameter values.

Figure 5A:
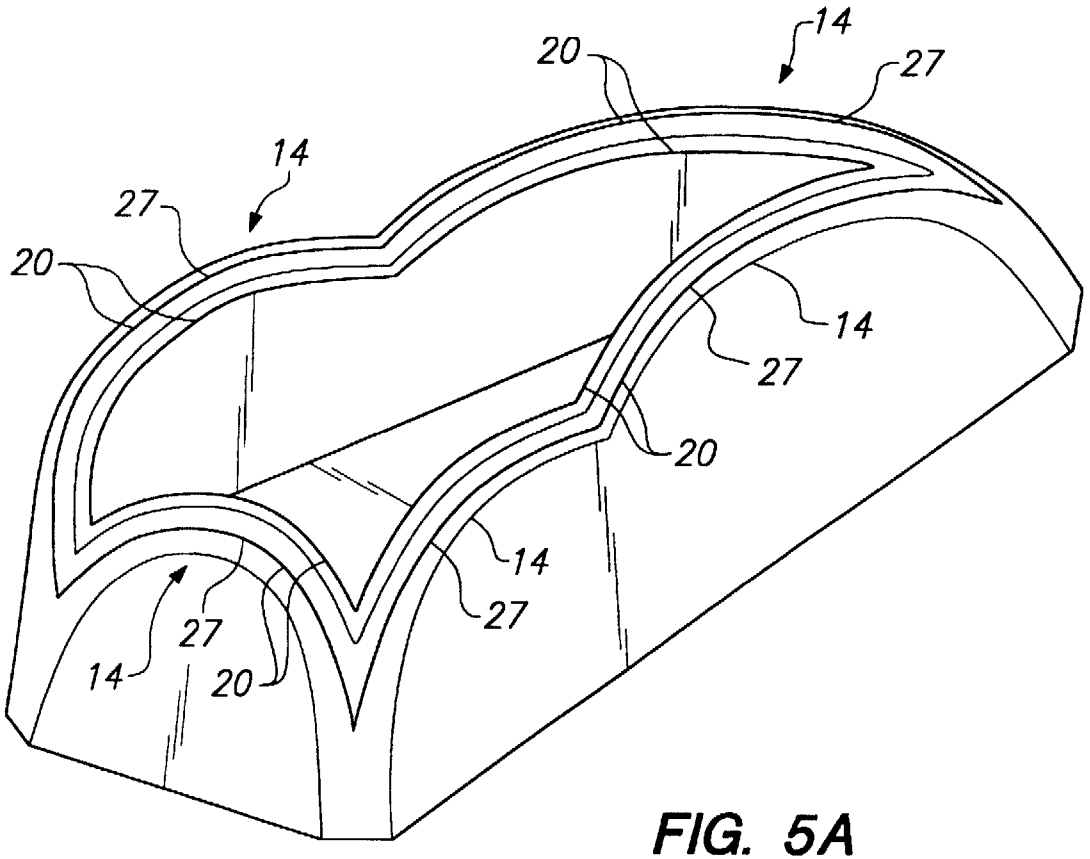
FIG. 5A is a perspective view of a ninth alternate embodiment of the spring system end cap of the present invention.
Figure 5B:
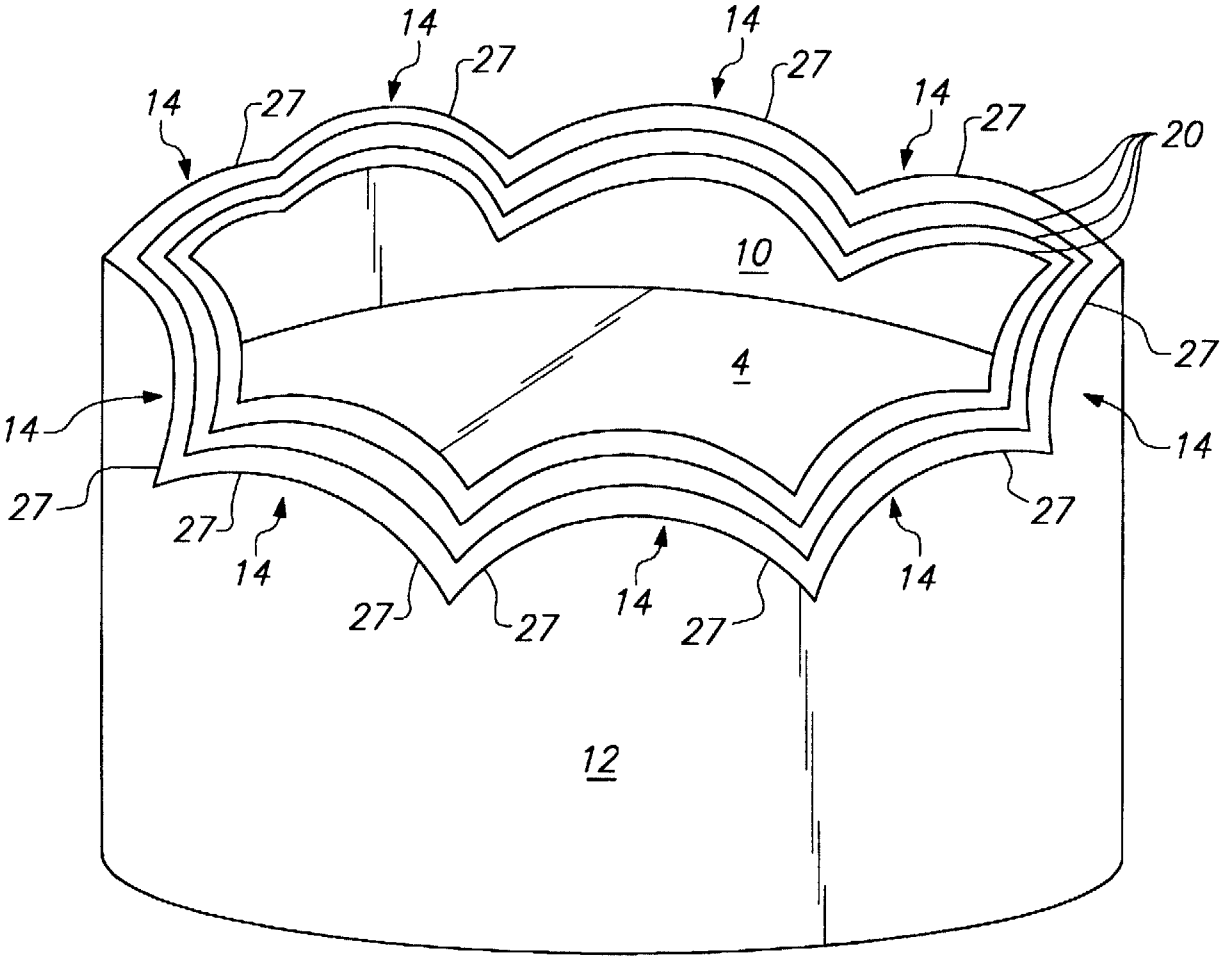
FIG. 5B is a perspective view of a tenth alternate embodiment of the spring system end cap of the present invention.

It should be noted that the present invention is not limited to rectangular (or square) platforms 4, but also includes platforms of other shapes as well, such as triangular (as illustrated in FIG. 5A), circular (as illustrated in FIG. 5B), oval, etc. The platform dimensions and shape can be changed to best fit the shape of the article while providing the desired shock/vibration dissipation. Further, end caps of different platform shapes and end cap design parameter values can be used to support different portions of the same article.

Figure 6A:
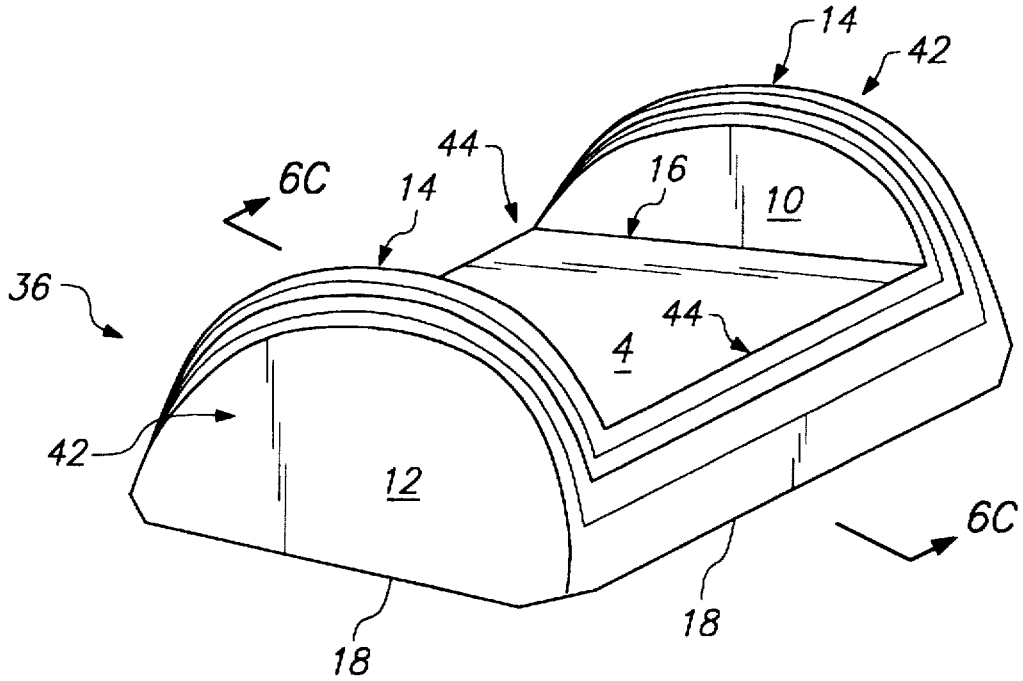
FIGS. 6A and 6B are perspective views of an eleventh alternate embodiment of the spring system end cap of the present invention.
Figure 6B:
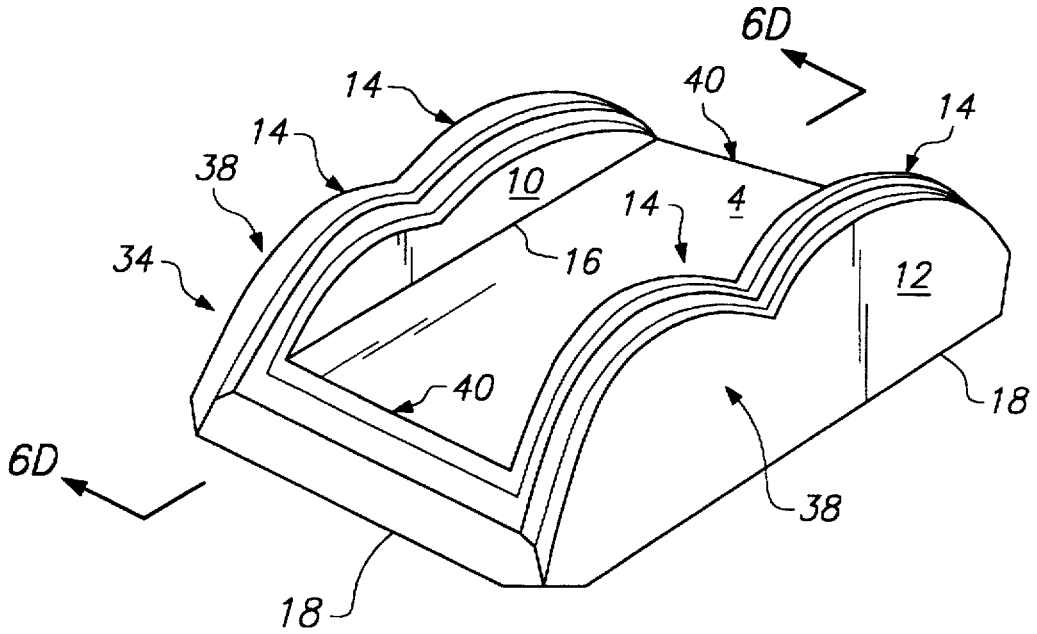

FIGS. 6A and 6B illustrate another embodiment of the end cap of the present invention. Complimentary end caps 34 and 36 are ideal for supporting a small article therebetween. End cap 34 has sidewall structures 38 that extend above platform 4 and sidewall structures 40 that are formed below platform 4. Likewise, end cap 36 has sidewall structures 42 that extend above platform 4 and sidewall structures 44 that are formed below platform 4. When a relatively small article is supported between platforms 4 of end caps 34/36, sidewall structures 38 are positioned opposite sidewall structures 44, and sidewall structures 40 are positioned opposite sidewall structures 42. This configuration allows the platforms 4 of end caps 34/36 to be positioned closer together without the sidewall structures 38 and 40 interfering with sidewall structures 42 and 44 respectively.

Figure 7A:
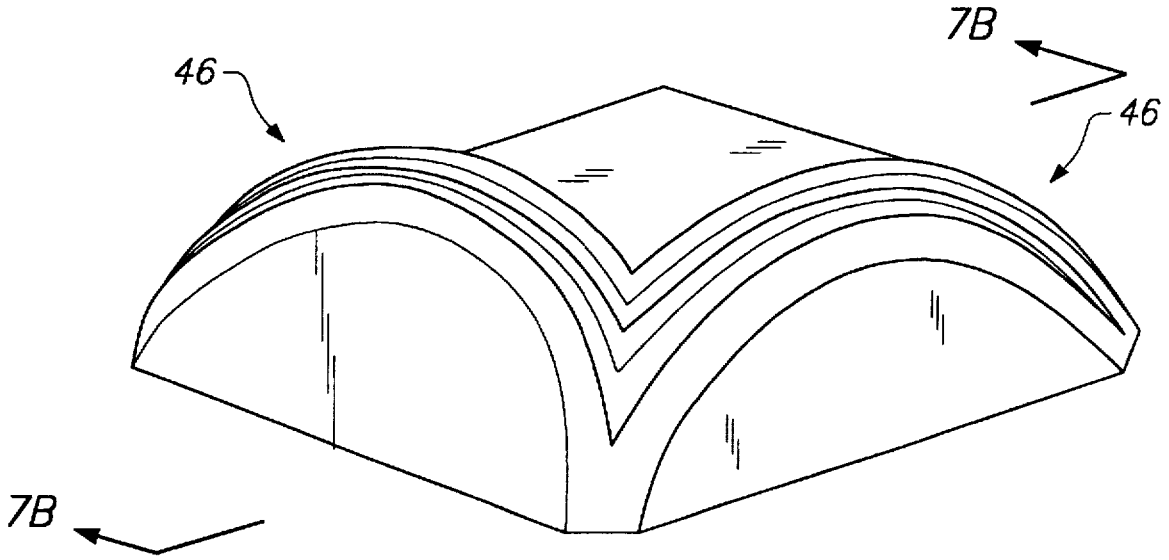
FIG. 7A is a perspective view of a twelfth alternate embodiment of the spring system end cap of the present invention.
Figure 7B:
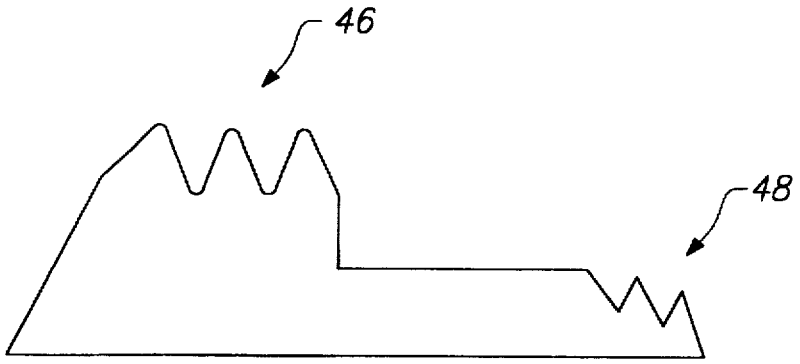
FIG. 7B is cross-sectional side view of the twelfth alternate embodiment of the spring system end cap of the present invention.

FIGS. 7A and 7B illustrate an embodiment of the end cap of the present invention having an open ended platform 4 for holding just a portion of an article. Platform 4 terminates on two sides with adjacent sidewall structures 46 that extend above platform 4, and with adjacent sidewall structures 48 that are formed below platform 4. This end cap embodiment is ideal for supporting a portion of the article, such as one corner, that extends beyond the platform 4.

Figure 8A:
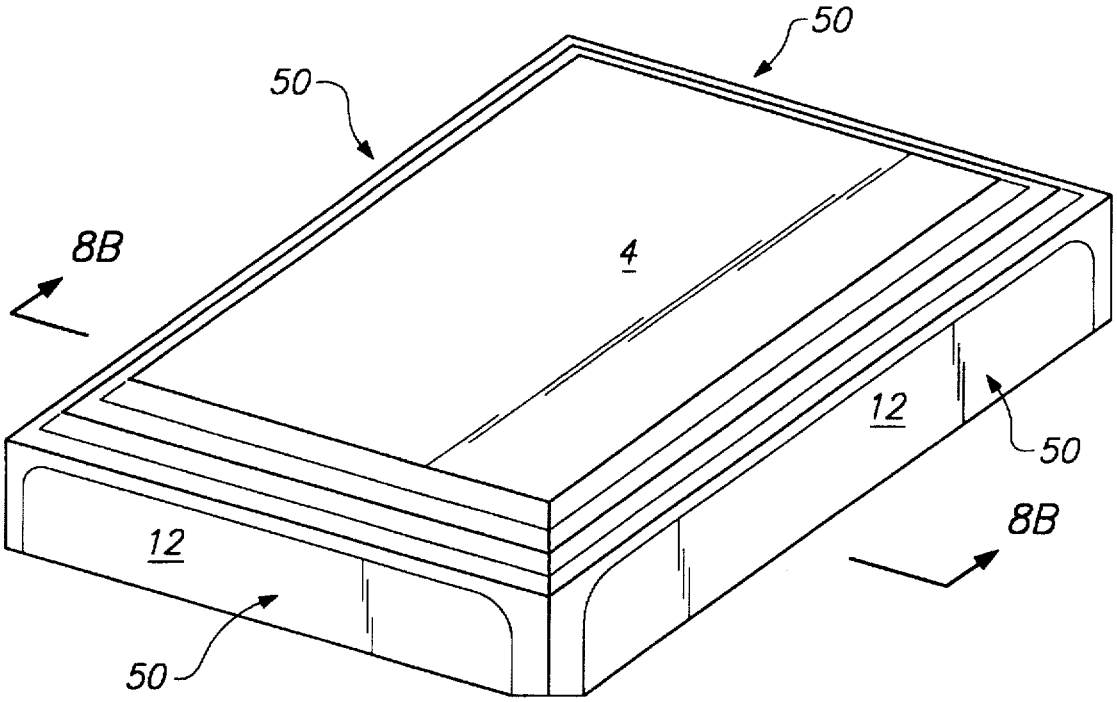
FIG. 8A is a perspective view of a thirteenth alternate embodiment of the spring system end cap of the present invention.
Figure 8B:
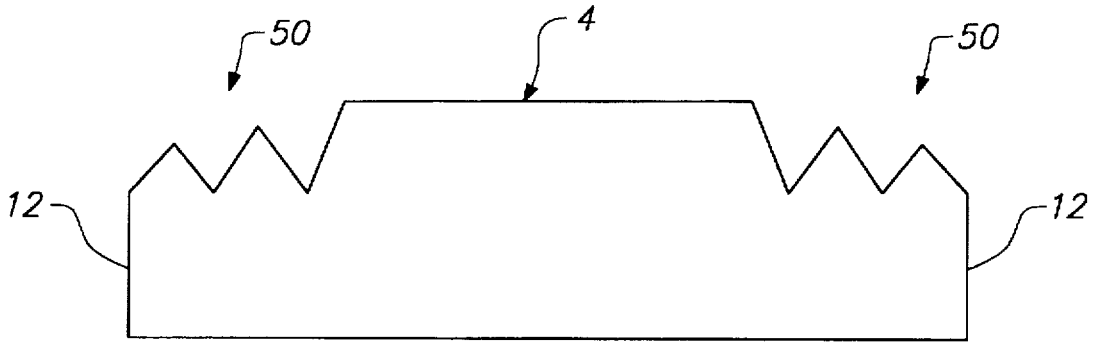
FIG. 8B is cross-sectional side view of the thirteenth alternate embodiment of the spring system end cap of the present invention.

FIGS. 8A and 8B illustrate an embodiment of the end cap of the present invention having sidewall structures 50 on all sides of the platform that are formed entirely below the platform 4. This embodiment is ideal for supporting a flat area portion of an article that is much larger than the area of the platform 4. The article can extend beyond the platform 4 without interfering with the sidewall structures 50.

It is to be understood that the present invention is not limited to the embodiments described above and illustrated herein, but encompasses any and all variations falling within the scope of the appended claims. For example, the end caps described herein can be used to ship any kind of article, whether it is fragile or not. Further, the name "end cap" does necessarily mean the end caps of the present invention hold the "ends" of the article.

What is claimed is:

1. A unitary spring system end cap for supporting an article, comprising:

a platform portion dimensioned to support at least a portion of the article; and a sidewall structure having a length and including:

an inner wall having proximal and distal edges, said distal edge joined to said platform portion, an outer wall having upper and lower edges, and at least one spring system integrally joined to said proximal edge of said inner wall and said upper edge of said outer wall and spacing said inner wall from said outer wall, said spring system including at least one flexible harmonic bellows forming a flexible ridge that has an arcuate shape along the length of said sidewall structure;

wherein said outer wall extends below said distal edge of said inner wall so that said platform portion is supported above said lower edge of said outer wall.

2. The unitary spring system end cap as recited in claim 1, further comprising:

at least one protruding dimple portion formed in said inner wall for engaging the article to create a friction fit.

3. The unitary spring system end cap as recited in claim 1, wherein said sidewall structure includes a plurality of said spring systems formed end to end, wherein said ridges from said plurality of spring systems form a plurality of arcs connected end to end along the length of said sidewall structure.

4. The unitary spring system end cap as recited in claim 3, wherein one of said plurality of arcs has a different radius of curvature than another of said plurality of arcs.

5. The unitary spring system end cap as recited in claim 1, wherein each of said bellows is formed by two elastic plate portions joined together at a predetermined angle to form said ridge.

6. The unitary spring system end cap as recited in claim 5, wherein said spring system includes a plurality of said harmonic bellows formed side by side, and wherein bottom edges of adjacent plate portions from adjacent harmonic bellows are joined together to form a channel that has an arcuate shape along the length of said sidewall structure.

7. The unitary spring system end cap as recited in claim 6, wherein said predetermined angle of one of the ridges of said plurality of harmonic bellows is unequal to said predetermined angle of another of the ridges of said plurality of harmonic bellows.

8. The unitary spring system end cap as recited in claim 5, wherein:

said sidewall structure includes a plurality of said spring systems formed end to end, the ridges from said plurality of spring systems form a plurality of arcs connected end to end along the length of said sidewall structure; and each of said plurality of spring systems includes a plurality of said harmonic bellows formed side by side, bottom edges of adjacent plate portions from adjacent harmonic bellows are joined together to form a channel that has an arcuate shape along the length of said sidewall structure.

9. The unitary spring system end cap as recited in claim 1, wherein said harmonic bellows is substantially linear along the length of said sidewall structure.

10. The unitary spring system end cap as recited in claim 1, wherein said harmonic bellows is substantially circular along the length of said sidewall structure.

11. The unitary spring system end cap as recited in claim 1, wherein:

said sidewall structure is a first sidewall structure;

said spring system end cap further comprising a second sidewall structure having a length and including:

a proximal edge joined to said platform portion, an outer wall having upper and lower edges, and at least one spring system integrally joined to said proximal edge and said upper edge of said outer wall, said spring system including at least one flexible harmonic bellows forming a flexible ridge along the length of said second sidewall structure, said outer wall extends below said proximal edge so that said platform portion is supported above said lower edge of said outer wall; and said first sidewall structure extends above said platform and said second sidewall structure is formed entirely below said platform.

12. A unitary spring system end cap for supporting an article, comprising:

a platform portion dimensioned to support at least a portion of the article; and a plurality of sidewall structures each having a length and including:

an inner wall having proximal and distal edges, said distal edge joined to said platform portion, an outer wall having upper and lower edges, and at least one spring system integrally joined to said proximal edge of said inner wall and said upper edge of said outer wall and spacing said inner wall from said outer wall, said spring system including at least one flexible harmonic bellows forming a flexible ridge that has an arcuate shape along the length of said sidewall structure;

wherein said outer walls extend below said distal edges of said inner walls so that said platform portion is supported above said lower edges of said outer walls.

13. The unitary spring system end cap as recited in claim 12, further comprising:

at least one protruding dimple portion formed in at least one of said inner walls for engaging the article to create a friction fit.

14. The unitary spring system end cap as recited in claim 12, wherein at least one of said sidewall structures includes a plurality of said spring systems formed end to end, wherein said ridges from said plurality of spring systems form a plurality of arcs connected end to end along the length of said sidewall structure.

15. The unitary spring system end cap as recited in claim 14, wherein one of said plurality of arcs has a different radius of curvature than another of said plurality of arcs.

16. The unitary spring system end cap as recited in claim 12, wherein said arcuate shaped ridge of one of said plurality of sidewall structures has a different radius of curvature than said actuate shaped ridge of another of said plurality of sidewall structures.

17. The unitary spring system end cap as recited in claim 12, wherein each of said bellows is formed by two elastic plate portions joined together at a predetermined angle to form said ridge.

18. The unitary spring system end cap as recited in claim 17, wherein at least one of said spring systems includes a plurality of said harmonic bellows formed side by side, and wherein bottom edges of adjacent plate portions from adjacent harmonic bellows are joined together to form a channel that has an arcuate shape along the length of said sidewall structure.

19. The unitary spring system end cap as recited in claim 18, wherein said predetermined angle of one of the ridges of said plurality of harmonic bellows is unequal to said predetermined angle of another of the ridges of said plurality of harmonic bellows.

20. The unitary spring system end cap as recited in claim 17, wherein said predetermined angle of one of said ridges of one of said spring systems is unequal to said predetermined angle of another of said ridges of another of said spring systems.

21. The unitary spring system end cap as recited in claim 17, wherein:

at least one of said sidewall structures includes a plurality of said spring systems formed end to end, the ridges from said plurality of spring systems form a plurality of arcs connected end to end along the length of said sidewall structure, and each of said plurality of said spring systems includes a plurality of said harmonic bellows formed side by side, bottom edges of adjacent plate portions from adjacent harmonic bellows are joined together to form a channel that has an arcuate shape along the length of said at least one sidewall structure.

22. The unitary spring system end cap as recited in claim 12, wherein said sidewall structures are substantially linear.

23. The unitary spring system end cap as recited in claim 12, wherein said sidewall structures are substantially circular.

24. The unitary spring system end cap as recited in claim 12, wherein a first and a second of said sidewall structures connect together at a corner structure formed such that said harmonic bellows of said first sidewall structure do not contact said harmonic bellows of said second sidewall structure during deflection of said platform.

25. The unitary spring system end cap as recited in claim 12, wherein:

said plurality of sidewall structures is a first plurality of sidewall structures;

said unitary spring system end cap further comprises a second plurality of sidewall structures each having a length and including:

a proximal edge joined to said platform portion, an outer wall having upper and lower edges, and at least one spring system integrally joined to said proximal edge and said upper edge of said outer wall, said spring system including at least one flexible harmonic bellows forming a flexible ridge along the length of said sidewall structure, wherein said outer walls extend below said proximal edges so that said platform portion is supported above said lower edges of said outer walls; and said first plurality of sidewall structures extend above said platform and said second plurality of sidewall structures is formed entirely below said platform.

26. A unitary spring system end cap for supporting an article, comprising:

a platform portion dimensioned to support at least a portion of the article; and a sidewall structure having a length and including:

an inner wall having proximal and distal edges, said distal edge joined to said platform portion, an outer wall having upper and lower edges, and at least one spring system integrally joined to said proximal edge of said inner wall and said upper edge of said outer wall and spacing said inner wall from said outer wall, said spring system including a plurality of flexible harmonic bellows formed side by side and forming flexible ridges along the length of said sidewall structure;

wherein said outer wall extends below said distal edge of said inner wall so that said platform portion is supported above said lower edge of said outer wall, and wherein said outer wall extends below said harmonic bellows so that said harmonic bellows are supported above said lower edge of said outer wall.

27. The unitary spring system end cap as recited in claim 26, further comprising:

at least one protruding dimple portion formed in said inner wall for engaging the article to create a friction fit.

28. The unitary spring system end cap as recited in claim 26, wherein each of said bellows is formed by two elastic plate portions joined together at a predetermined angle to form said ridge.

29. The unitary spring system end cap as recited in claim 28, wherein bottom edges of adjacent plate portions from adjacent harmonic bellows are joined together to form a channel along the length of said sidewall structure.

30. The unitary spring system end cap as recited in claim 29, wherein said predetermined angle of one of the ridges of said plurality of harmonic bellows is unequal to said predetermined angle of another of the ridges of said plurality of harmonic bellows.

31. The unitary spring system end cap as recited in claim 26, wherein said plurality of harmonic bellows are substantially linear along the length of said sidewall structure.

32. The unitary spring system end cap as recited in claim 26, wherein said plurality of harmonic bellows are substantially circular along the length of said sidewall structure.

33. The unitary spring system end cap as recited in claim 26, wherein:

said sidewall structure is a first sidewall structure;

said spring system end cap further comprising a second sidewall structure having a length and including:

a proximal edge joined to said platform portion, an outer wall having upper and lower edges, and at least one spring system integrally joined to said proximal edge and said upper edge of said outer wall, said spring system including at least one flexible harmonic bellows forming a flexible ridge along the length of said second sidewall structure, said outer wall extends below said proximal edge so that said platform portion is supported above said lower edge of said outer wall; and said first sidewall structure extends above said platform and said second sidewall structure is formed entirely below said platform.

34. A unitary spring system end cap for supporting an article, comprising:

a platform portion dimensioned to support at least a portion of the article; and a plurality of sidewall structures each having a length and including:

a proximal edge joined to said platform portion, an outer wall having upper and lower edges, and at least one spring system integrally joined to said proximal edge and said upper edge of said outer wall, said spring system including at least one flexible harmonic bellows forming a flexible ridge along the length of said sidewall structure;

wherein said outer walls extend below said proximal edges of said plurality of sidewall structures so that said platform portion is supported above said lower edges of said outer walls, and wherein said plurality of sidewall structures is formed entirely below said platform.

35. A unitary spring system end cap for supporting an article, comprising:

a platform portion dimensioned to support at least a portion of the article; and a sidewall structure having a length and including:

an inner wall having proximal and distal edges, said distal edge joined to said platform portion, an outer wall having upper and lower edges, and at least one spring system integrally joined to said proximal edge of said inner wall and said upper edge of said outer wall and spacing said inner wall from said outer wall, said spring system including a plurality of flexible harmonic bellows formed side by side and forming flexible ridges along the length of said sidewall structure;

wherein said outer wall extends below said distal edge of said inner wall so that said platform portion is supported above said lower edge of said outer wall, and wherein each of said bellows is formed by two elastic plate portions joined together at a predetermined angle to form said ridge with bottom edges of adjacent plate portions from adjacent harmonic bellows being joined together to form a channel along the length of said sidewall structure, and further wherein said predetermined angle of one of the ridges of said plurality of harmonic bellows is unequal to said predetermined angle of another of the ridges of said plurality of harmonic bellows.

36. A unitary spring system end cap for supporting an article, comprising:

a platform portion dimensioned to support at least a portion of the article; and a sidewall structure having a length and including:

an inner wall having proximal and distal edges, said distal edge joined to said platform portion, an outer wall having upper and lower edges, and at least one spring system integrally joined to said proximal edge of said inner wall and said upper edge of said outer wall and spacing said inner wall from said outer wall, said spring system including a plurality of flexible harmonic bellows formed side by side and forming flexible ridges along the length of said sidewall structure;

wherein said outer wall extends below said distal edge of said inner wall so that said platform portion is supported above said lower edge of said outer wall, and wherein said plurality of harmonic bellows are substantially circular along the length of said sidewall structure.

* * * * *